US008875771B2

(12) United States Patent
Colson et al.

(10) Patent No.: US 8,875,771 B2
(45) Date of Patent: Nov. 4, 2014

(54) SINGLE TRACK STACKING PANEL COVERING FOR AN ARCHITECTURAL OPENING

(75) Inventors: Wendell B. Colson, Weston, MA (US); Jeffrey A. Park, Miami Beach, FL (US)

(73) Assignee: Hunter Douglas Inc., Pearl River, NY (US)

( * ) Notice: Subject to any disclaimer, the term of this patent is extended or adjusted under 35 U.S.C. 154(b) by 0 days.

(21) Appl. No.: 13/159,162

(22) Filed: Jun. 13, 2011

(65) Prior Publication Data

US 2011/0290430 A1 Dec. 1, 2011

Related U.S. Application Data

(62) Division of application No. 11/665,892, filed as application No. PCT/US2005/039822 on Nov. 3, 2005, now Pat. No. 7,958,926.

(60) Provisional application No. 60/624,916, filed on Nov. 4, 2004.

(51) Int. Cl.
*E06B 9/36* (2006.01)
*A47H 23/02* (2006.01)

(52) U.S. Cl.
CPC ..... *E06B 9/36* (2013.01); *A47H 2201/02* (2013.01); *A47H 2201/01* (2013.01); *A47H 2023/025* (2013.01)
USPC ..... 160/168.1 V; 160/176.1 V

(58) Field of Classification Search
USPC ..... 160/184, 183, 88, 196.1, 197, 178.1 V, 160/168.1 V, 900, 203, 172 V, 173 V, 160/176.1 V, 177 V, 345, 202, 198, 200
See application file for complete search history.

(56) References Cited

U.S. PATENT DOCUMENTS

| | | | | |
|---|---|---|---|---|
| 1,468,433 A | | 9/1923 | Zackow | |
| 1,648,851 A | * | 11/1927 | Lapin | 160/89 |
| 2,756,817 A | * | 7/1956 | Toti | 160/173 R |
| 2,759,534 A | | 8/1956 | Harju | |
| 3,260,303 A | | 7/1966 | Pipe | |
| 3,280,891 A | * | 10/1966 | Eldredge, Jr. et al. | 160/172 R |
| 3,342,245 A | | 9/1967 | Rene | |

(Continued)

FOREIGN PATENT DOCUMENTS

| | | |
|---|---|---|
| CA | 2506623 A1 | 5/2005 |
| CN | 2152066 | 1/1994 |

(Continued)

OTHER PUBLICATIONS

Patent Examination Report No. 2 in corresponding AU application No. 2005305002, Jun. 29, 2010.

(Continued)

*Primary Examiner* — David Purol
(74) *Attorney, Agent, or Firm* — Day Pitney LLP; Brian R. Pollack

(57) ABSTRACT

A single-track stacking panel covering for an architectural opening has a headrail for mounting the covering above and in front of the opening, such as a window or door. The headrail has a single track. Suspended from the headrail and translatable therealong are panels oriented at a small angle relative to the headrail. When the covering is open, the panels form an overlappingly stacked array at one end of the headrail.

8 Claims, 30 Drawing Sheets

(56) References Cited

U.S. PATENT DOCUMENTS

| | | | | | |
|---|---|---|---|---|---|
| 3,348,603 | A | | 10/1967 | Ford | |
| 3,574,887 | A | | 4/1971 | Schindlauer | |
| 3,911,991 | A | | 10/1975 | Malferrari | |
| 4,114,674 | A | * | 9/1978 | Gabry | 160/222 |
| 4,221,255 | A | | 9/1980 | Barkemeyer | |
| 4,257,470 | A | | 3/1981 | Woodle | |
| 4,291,738 | A | | 9/1981 | Grenga et al. | |
| 4,293,021 | A | | 10/1981 | Arena | |
| 4,425,956 | A | | 1/1984 | Terlecke | |
| 4,765,022 | A | | 8/1988 | Siegal et al. | |
| 4,936,370 | A | | 6/1990 | Uecker et al. | |
| 4,998,577 | A | * | 3/1991 | Kobayashi et al. | 160/202 |
| 5,109,910 | A | | 5/1992 | Tortorella et al. | |
| 5,168,913 | A | | 12/1992 | Haines | |
| 5,289,863 | A | | 3/1994 | Schon | |
| 6,408,923 | B1 | | 6/2002 | Nien | |
| 6,585,025 | B2 | | 7/2003 | Welfonder | |
| 6,589,613 | B1 | | 7/2003 | Kunert | |
| 6,892,783 | B1 | | 5/2005 | Comeau et al. | |
| 6,957,682 | B2 | | 10/2005 | Huang et al. | |
| 7,665,501 | B2 | | 2/2010 | Colson | |
| 2007/0158036 | A1 | * | 7/2007 | Lin | 160/197 |

FOREIGN PATENT DOCUMENTS

| | | | |
|---|---|---|---|
| CN | 2634076 | Y | 8/2004 |
| DE | 2909240 | | 9/1980 |
| GB | 2106771 | | 4/1983 |
| JP | 1-18411 | Y2 | 7/1984 |
| JP | 5-10128 | Y2 | 3/1993 |
| JP | 10121828 | A | 5/1998 |
| JP | 10299338 | A | 11/1998 |
| JP | 11256910 | A | 9/1999 |
| JP | 11294037 | A | 10/1999 |
| JP | 2004003212 | A | 1/2004 |
| JP | 2004003213 | A | 1/2004 |
| JP | 2004108007 | A | 4/2004 |
| KR | 1020050086493 | A | 8/2005 |
| WO | 2004/048738 | A1 | 6/2004 |
| WO | 2008/054497 | A2 | 5/2008 |

OTHER PUBLICATIONS

Patent Examination Report No. 1 in corresponding AU application No. 2011201002, Jul. 23, 2012.

English and Chinese Text of First Office Action in corresponding CN application No. 20058003804.9.

International Search Report, in related PCT application No. PCT/US05/39822, Jun. 22, 2007.

International Preliminary Report on Patentability and Written Opinion of the International Searching Authority, in related PCT application No. PCT/US05/39822, Jun. 22, 2007.

Non-Final Office Action in corresponding U.S. Appl. No. 11/665,892, May 24, 2010.

First Examination Report in corresponding IN application No. 572/MUMNP/2007, Feb. 28, 2013.

* cited by examiner

SINGLE TRACK STACKING PANEL COVERING FOR AN ARCHITECTURAL OPENING

This application is a divisional application of Ser. No. 11/665,892 filed on Nov. 15, 2007 now U.S. Pat. No. 7,958,926 and claims priority therefrom as well as from PCT/US2005/039822, filed on Nov. 3, 2005, and U.S. PA 60/624,916, filed on Nov. 4, 2004, the entire contents of each of which are incorporated herein by reference.

BACKGROUND OF THE INVENTION

1. Field of the Invention

The present invention relates to vertically hanging paneled coverings for architectural openings, such as doors and windows, particularly where the latter extend substantially from the floor to the ceiling. More specifically, the present invention relates to coverings of this variety where, when opened, the individual panels making up the covering form a vertically hanging stack on one of the two sides of the opening, and, when closed, the individual panels cannot be rotated about their vertical axes.

2. Description of the Relevant Art

There are at least several examples of coverings of this general type in the relevant U.S. patent art.

U.S. Pat. No. 3,260,303 to Pipe shows a multi-panel sliding door having a plurality of vertically supported panels interconnected by a system of structural elements which provide a simultaneous progressive sliding motion of the panels in moving one panel behind another when the structure is opened from either end.

U.S. Pat. No. 3,342,245 to Caillet shows a retractable cover for closing horizontal or substantially horizontal openings, such as hatchways on ships. The cover comprises a plurality of interconnected panels which are stacked one atop the next at the free end of the cover as it is opened. When closed, the cover is capable of supporting heavy loads.

U.S. Pat. No. 3,348,603 to Ford shows a movable panel assembly comprising elongated overhead track means having a plurality of lengthwise extending, laterally spaced, externally opening passageways therein. Elongated carriers extend into the passageways and are supported thereon for lengthwise movement along the track means. The carriers each have an externally extending wall portion which presents a mounting surface on which a panel can be mounted, whereby the panels are mounted on the carriers for lengthwise movement therewith. The panels are normally of width equal to the length of the mounting surface and preferably have substantial stiffness so that they can be supported upon the carriers without sagging or folding. The panels are each supported on the respective carriers so that they are flat and unpleated whereby they create an effect similar to that of a hanging tapestry. Stop means are provided for positioning and preventing movement of the carriers in one direction past each other at one end of the track whereby the carriers can be positioned in a fully overlapping, aligned relation in which only the forward most one of the panels is exposed to view.

U.S. Pat. No. 3,574,887 to Schindlauer shows a curtain holder having miming slots for gliders. The holder incorporates a face panel for hiding the upper portion of the curtains and gliders. The face panel is removably attached to the holder by a snap joint fit. The face panel can also be applied to the ends of the holder, and friction insert means are used to assist in attaching the ends of the face panel to the holder.

U.S. Pat. No. 3,911,991 to Malferrari shows a curtain comprising a stationary supporting device, formed by a plurality of modular elements and by two end pieces, and provided with longitudinal guiding channels or runways with a longitudinal lower slot. The curtain also has a plurality of box-like elongated members, slidingly mounted in some of the longitudinal runways, and of a plurality of panels each formed of a length of cloth or other flexible laminar material and carried by one of the box-like members. The end pieces of the stationary supporting device are adapted to telescopically receive for the desired extent the facing end of the stationary supporting device, while each box-like member supports the pertinent panel by means of a first composite bar adapted to lock, in releasable manner, the upper edge of the cloth length thereto. The lower portion of the cloth length that exceeds the useful cloth is rolled up and accommodated in the inside of a second composite bar, having means to enable a relative movement between two adjacent panels to pass from an overlapping relationship to a substantially aligned relationship and to be then moved in unison as train elements drawn by a pilot panel with the vertical edges of two adjacent panels overlapping one another for a desired adjustable extent.

U.S. Pat. No. 4,221,255 to Barkemeyer shows a decorative panel assembly having a valance board which receives and maintains a plurality of tracks. The tracks receive rollers connected to decorative panels. The panels and valance board are provided with edge clamps which act as moldings or are used for securing decorative coverings thereto. A first source of illumination is provided in the valance board and in front of the panels to cast light upon the same. A second light source is vertically positioned behind the end panels for creating an indirect lighting or ghosting effect. A spring-biased curtain rod holder may be maintained within the valance board and behind the panels, if so desired.

U.S. Pat. No. 5,109,910 to Tortorella et al. shows a vertical curtain panel assembly for covering windows, sliding glass doors and the like with a plurality of large, wide, highly decorative panels. The panel assembly includes a plurality of interconnectable frame units having a plurality of channels with movable carriers positioned therein, and disposed such that by utilizing a single draw string attached to a single carrier, the plurality of carriers having decorative panels extending therefrom, may be readily moved between an opened position, wherein all the panels are concealed behind an outermost fixed panel, and a closed window-covering position, wherein each panel is exposed and covers a designated area.

SUMMARY OF THE INVENTION

The present invention is a single-track stacking panel covering for an architectural opening. As implied by this characterization, the covering has a plurality of panels translatably mounted on and suspended from a single track.

More specifically, the single-track stacking panel covering comprises a headrail for mounting the covering above and in front of an architectural opening, such as a window or door. The headrail has a longitudinal direction, a first and a second end, and a single track running in the longitudinal direction.

A plurality of carriers is disposed on the single track. The carriers are translatable in the longitudinal direction of the headrail to open and close the covering.

A plurality of panels is suspended below the headrail. One panel is suspended from each of the carriers, and each panel is oriented at a substantially fixed oblique angle relative to the longitudinal direction of the headrail.

Also included are means for slidably linking each of the panels to those adjacent thereto, so that the panels may form an overlappingly stacked array at one of the two ends of the headrail by sliding one behind the next when the covering is opened.

In a preferred embodiment, the single-track stacking panel covering comprises a headrail for mounting the covering above and in front of an architectural opening. In this embodiment, the headrail has a longitudinal direction, an interior, a first end and a second end, and a single track having a first rail and a second rail running in the longitudinal direction and parallel to one another.

A plurality of carriers is disposed on each of the first and second rails of the single track. The carriers are translatable in the longitudinal direction along the first and second rails of the headrail to open and close the covering. The carriers on the first rail are linked to one another, so that when a first carrier is moved along the first rail, it moves the next one and subsequently others in turn to close the covering.

A plurality of hangers having first and second ends connects carriers on the first rail to carriers on the second rail. The first ends of the hangers, more specifically, are attached to carriers on the first rail, and the second end of the hangers are attached to carriers on the second rail, thereby linking carriers on the two rails together.

A plurality of panels is suspended below the headrail from the plurality of hangers, one panel being suspended from each hanger. Each of the panels is oriented at a substantially fixed oblique angle relative to the longitudinal direction of the headrail. The panels all have a width, and a bottom and a top.

A cord-guiding member is disposed at each of the first and second ends of the headrail. Each cord-guiding member has a first hole and a second hole which communicate with the interior of the headrail.

A cord, having a first end and a second end attached to one of the carriers on the first rail, is used to open and close the covering. The cord runs from the first end at the carrier within the headrail and outwardly through the first hole of the cord-guiding member at the first end of the headrail; then enters the headrail through the second hole of the cord-guiding member at the first end of the headrail and runs through the headrail and outwardly through the first hole of the cord-guiding member at the second end of the headrail; then re-enters the headrail through the second hole of the cord-guiding member at the second end of the headrail and runs to the second end at the carrier. The cord forms a loop at one of the first and second ends of the headrail. By pulling one side of the loop, or the other, the carrier is pulled one way or the other along the first rail, thereby opening or closing the covering.

In other preferred embodiment, similar to that just described, a plurality of carriers is disposed on each of the first and second rails of the single track. The carriers are again translatable in the longitudinal direction along the first and second rails of the headrail to open and close the covering. Some of the carriers on the first rail are linked to one another to form a first group of carriers and the remainder of the carriers on the first rail are linked to one another to form a second group of carriers.

In this embodiment, a cord, having a first and second end attached to one of the carriers in the first group on the first rail, is used to open and close the covering. The cord runs from the first end at the carrier within the headrail and outwardly through a first opening in the cord-guiding member at the first end of the headrail; then enters the headrail through a second opening of the cord-guiding member at the first end and runs through the headrail toward the second end, the cord being attached to a carrier on the second rail connected by a hanger to a carrier in the second group on the first rail and continuing through the headrail and outwardly through the first opening of the cord-guiding member at the second end of the headrail; then re-enters the headrail through the second hole of the cord-guiding member at the second end of the headrail and runs to the second end at the carrier of the first group. In this manner, the cord moves the carriers of the two groups in opposite directions when it is moved to provide a "center draw" covering.

The present invention will now be described in more complete detail with frequent reference being made to the figures identified below.

DETAILED DESCRIPTION OF THE PREFERRED EMBODIMENTS

Figure 1:
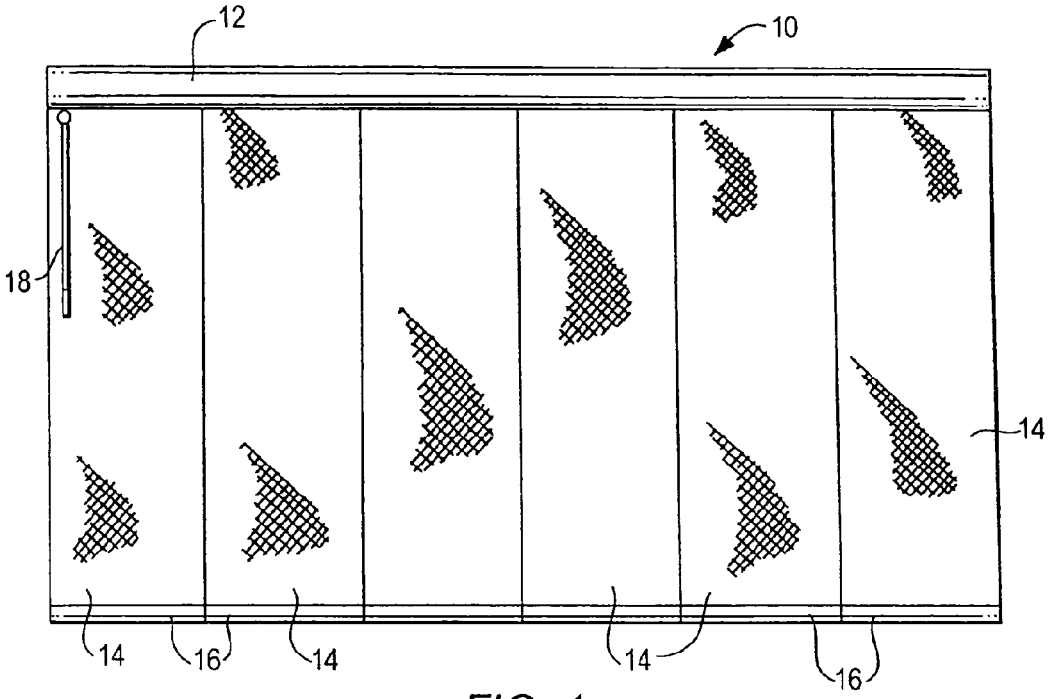
FIG. 1 is a plan view of the single-track stacking panel covering of the present invention when closed.
Figure 2:
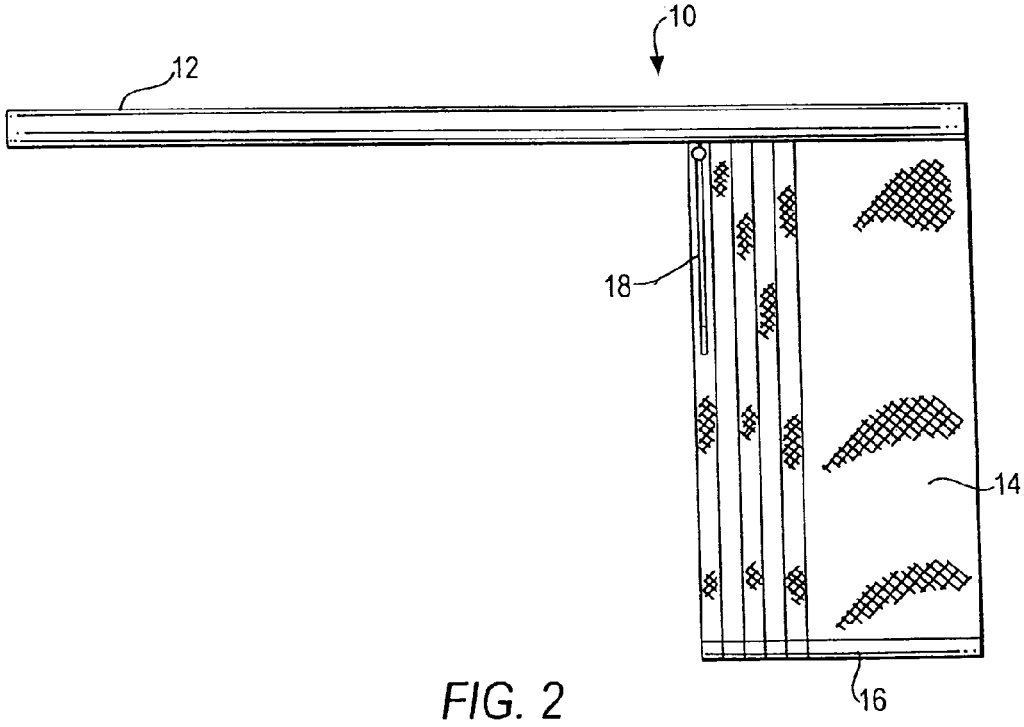
FIG. 2 is a plan view of the covering when fully opened.

Turning now more particularly to these figures, FIGS. 1 and 2 are plan views of the covering 10 of the present invention when closed and opened, respectively. The covering 10 comprises a headrail 12 which is typically mounted across the top of a window, sliding door or other architectural opening. The covering 10 may extend from the top of the opening to below its bottom, or to a convenient distance above the floor, as may be dictated by the nature of the opening.

The covering 10 includes a plurality of individual panels 14, which are suspended and hang below the headrail 12 by means to be described below. The panels 14 themselves may be made of woven fabric of any of the materials and styles used in the manufacture of window shades and blinds. Alternatively, the panels may be made of metal sheet material, such as aluminum sheet, which may be perforated to some desired degree, or of plastic sheet, which also may be perforated. As for the plastic sheet, all colors and degrees of transparency thereof may be used to provide plastic sheet for panels 14.

It will be noted in FIGS. 1 and 2 that the covering 10 includes six panels 14. It should be understood that a greater number of narrower panels 14, or a smaller number of wider panels 14, could likewise be used to manufacture a covering 10 according to the invention.

At the bottom of each panel 14 is a bar 16 which extends for the width thereof. The bars 16, by virtue of their weight and stiffness, keep the panels 14 taut, particularly where they are made of fabric, to help them to hang vertically and to maintain proper alignment, swinging less when the covering is being opened or closed. Moreover, the bars 16 of adjacent panels 14 are linked together, by means to be discussed below, to prevent each panel 14 from swinging individually and tangling with its neighbors, and to ensure a pleasing appearance for the covering 10 as a whole by maintaining a parallel relationship among the panels 14, when the covering 10 is fully opened and fully closed.

A wand 18 is attached to the outboard side of the component, to be described more particularly below, from which panel 14 at the extreme right or left of the covering 10 is suspended, to enable the covering 10 to be opened or closed. As illustrated in FIGS. 1 and 2, covering 10 is opened by pulling wand 18 to the right. In so doing each panel 14 and bar 16 slides behind that to its right in the figures. When fully opened, panels 14 are overlappingly stacked with each panel 14 extending outward from beneath that in front of it in the stack by a fixed amount, which will be referred to as the stacking distance. The latter may be 1.0 inch, 2.0 inches or some other selected amount, as desired. When the covering is fully closed by pulling wand 18 to the left in FIG. 2 to the position shown in FIG. 1, each panel 14 overlaps that to its left by a small amount, perhaps 1.0 inch, so that the architectural opening, over which the covering 10 is disposed, is completely blocked when viewed from directly in front of the covering 10.

In FIGS. 1 and 2, the covering 10 is opened and closed using wand 18 at the extreme left. Panel 14 at the extreme right is essentially in a fixed position, with the remaining panels 14 sliding partly behind when the covering is being opened and sliding out from behind when the covering 10 is being closed. It is to be understood, and is within the scope of the present invention, that, alternatively, panel 14 at the extreme left may be fixed instead of that at the extreme right and that the covering 10 may be opened and closed using a wand 18 at the extreme right of rightmost panel 14. In this alternative, the opened covering 10 would have its overlappingly stacked panels 14 disposed on the left side of FIG. 2 as each panel 14 would slide partly over that to its left as the covering is being opened.

Figure 3:
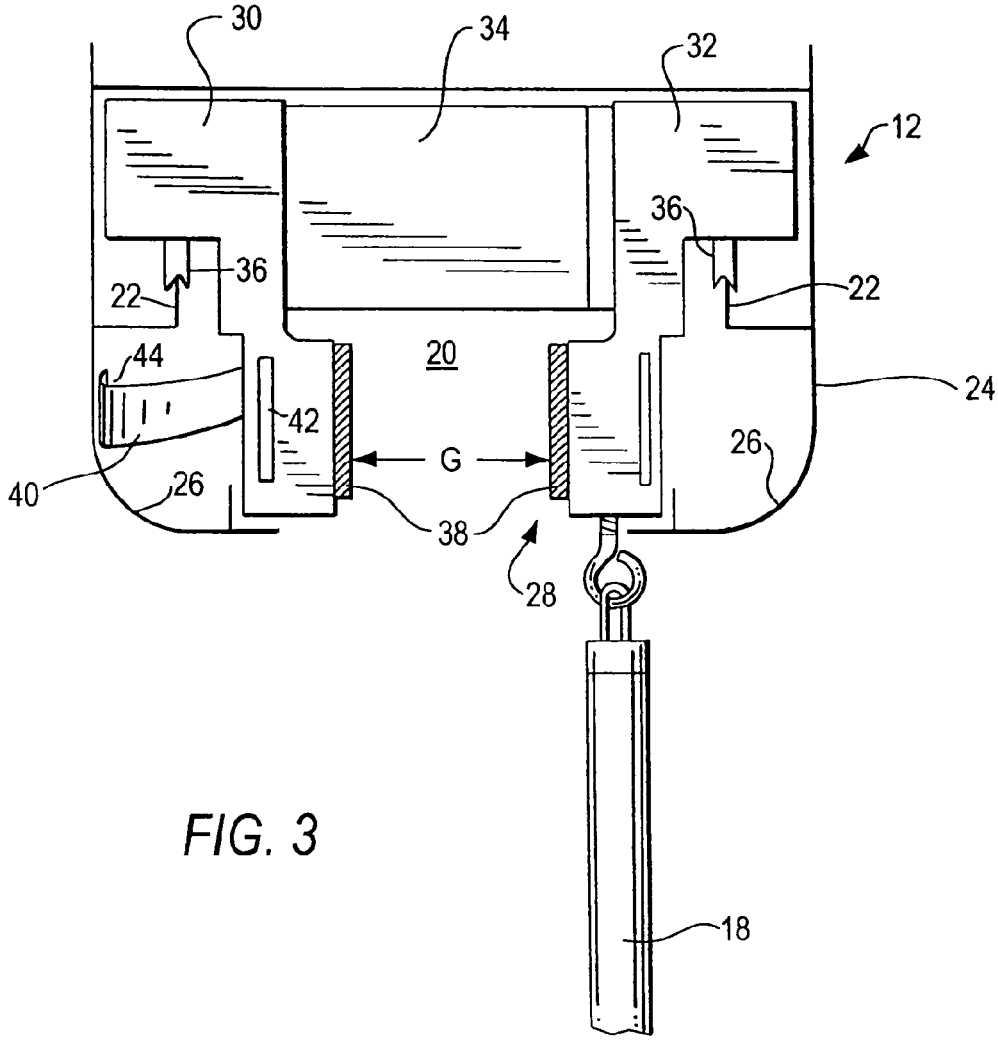
FIG. 3 is an end view of the headrail of the covering in accordance with a first embodiment of the invention.

Turning now to a first embodiment of the present invention, FIG. 3 is an end view of the headrail 12 of the covering 10 taken from the left side of FIG. 1. Headrail 12 may be integrally extruded from aluminum or plastic, and generally has an inverted U-shape forming a track 20, which has two rails 22. Face 24 is that which is oriented toward the viewer of FIGS. 1 and 2. Channels 26 are also provided in track 20.

Mounted on the rails 22 is a carrier 28 for one panel 14 viewed from the left end in FIG. 1. The carrier 28 comprises a rear holder 30, a front holder 32 and a connecting bar 34 joining the two holders 30, 32. In FIG. 3, rear holder 30 is somewhat farther away from the viewer than front holder 32. Each holder 30, 32 has a wheel 36 on which it may run upon its respective rail 22. Connecting bar 34 is oriented diagonally across channel 20 making a slight angle with respect to its longitudinal direction.

Holders 30, 32 also include fastener halves 38, which may be one of the two parts of a hook-and-loop fastener of the variety commonly referred to as a VELCRO® fastener. The other halves of each fastener are attached to upper corners on opposite sides of panels 14, so that each may be mounted from a carrier 28 from holders 30, 32. As a consequence, the panels 14 are also oriented diagonally across channel 20, although at a somewhat smaller angle relative to the longitudinal direction thereof than that made by connecting bar 34.

It will be appreciated that there are a plurality of holders 28 disposed in headrail 12, namely, one per panel 14. In the view presented in FIG. 3, however, only one holder 28 is visible, any others being behind it. However, each holder 28 is slidingly linked to the next by a strap 40, one of which is visible in one of the channels 26. Strap 40 passes through an opening on the side of rear holder 30 away from the viewer of FIG. 3 but identical to opening 42. Strap 40 ends in a hook 44 which can be caught by opening 42 and not be pulled out. Each holder 28 is linked to the next in this manner. As a consequence, the endmost holder 28 can pull sequentially all of the holders 28 and all but the last of the panels 14 across the headrail 12 to close the covering 10 using rod 18.

It will be noted that there is a gap "G" separating the two fastener halves 38 transversely across the headrail 12. Because the panels 14, not shown in FIG. 3, and their fastener halves also have some thickness, the gap at the overlap between each panel 14 and its neighbor will be somewhat smaller than gap "G", but it will be a constant for this embodiment because the attachment points for the panels 14 are always a fixed distance apart transversely across the channel 28.

Figure 4:
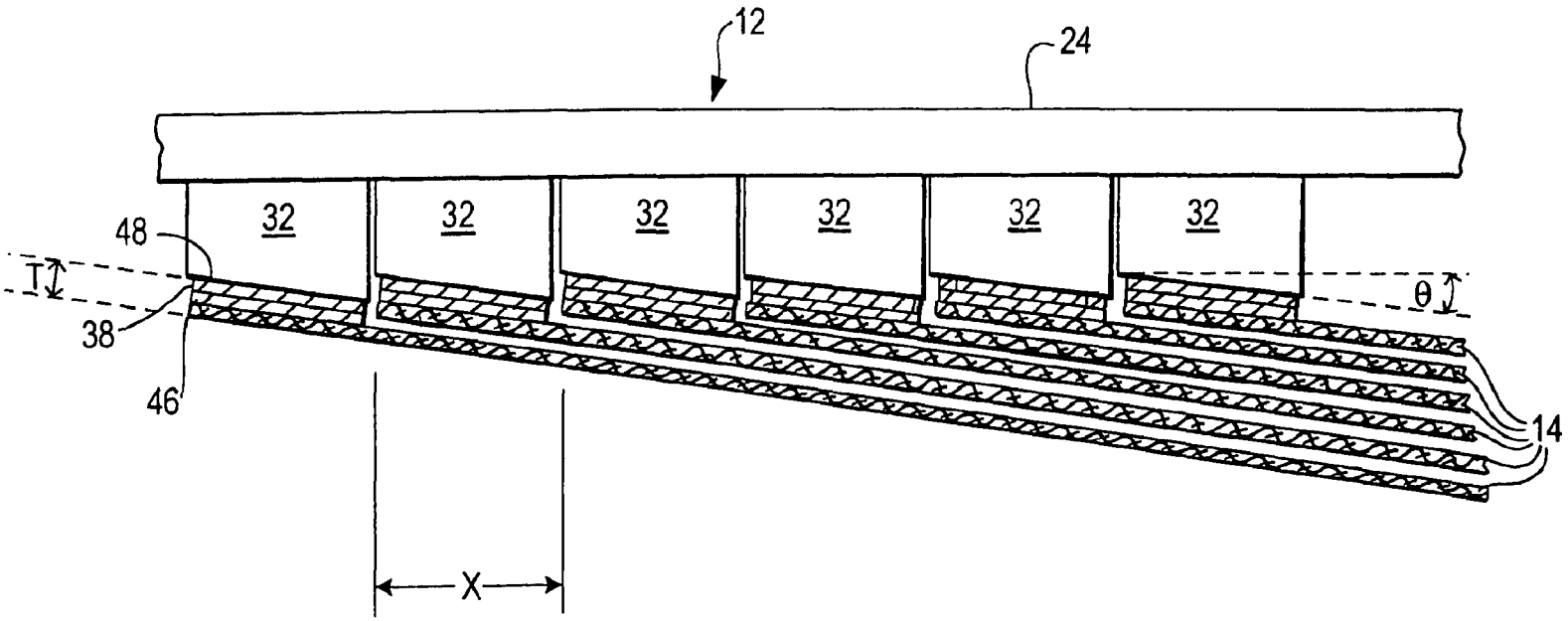
FIG. 4 is a schematic view taken from below the headrail when the covering is opened.

FIG. 4 is a schematic view of a portion of the headrail 12 viewed from below when the covering 10 is opened as shown in FIG. 2. Wand 18, which would be on the leftmost holder 32, has been omitted for the sake of clarity. Panels 14 are attached to holders 32 with fastener halves 38, 46. Fastener halves 46, of course, are attached to panels 14 and are the means by which the panels are mounted or suspended from the holders 30, 32. Fastener halves 38, 46, as noted above, may be the mutually interlocking portions of hook-and-loop fasteners, commonly known as VELCRO® fasteners.

Holders 32 are all of a common width, which may be seen to be the stacking distance "X", the amount one panel 14 extends beyond another when the covering 10 is opened and panels 14 form an overlapping stack. It will be noted, in the exaggerated, schematic view presented in FIG. 4, that the faces 48 of the holders 32, as well as those of holders 30 not shown, are inclined at an angle relative to the longitudinal direction of the headrail 12. The purpose of this inclination is to ensure that one panel 14 will be able to slide behind or in front of that next to it when the covering 10 is being opened without binding against it. It will be understood that the panels 14 and fastener halves 38, 46 together have a predetermined thickness "T". Accordingly, in order for the panels 14 to stack without binding when the covering 10 is opened, the angle θ is that whose sine is T/X. Alternatively, $$\theta = \arcsin T/X.$$

Accordingly, if the stacking distances is 1.0 inch and the panel 14 and fastener halves 38,46 have a combined thickness of 0.025 inch, sin θ would be 0.025 and θ would be about 1.4°. Of course, for different stacking distances and thicknesses, angle θ would change in accordance with the relationship set forth above.

Figure 5:
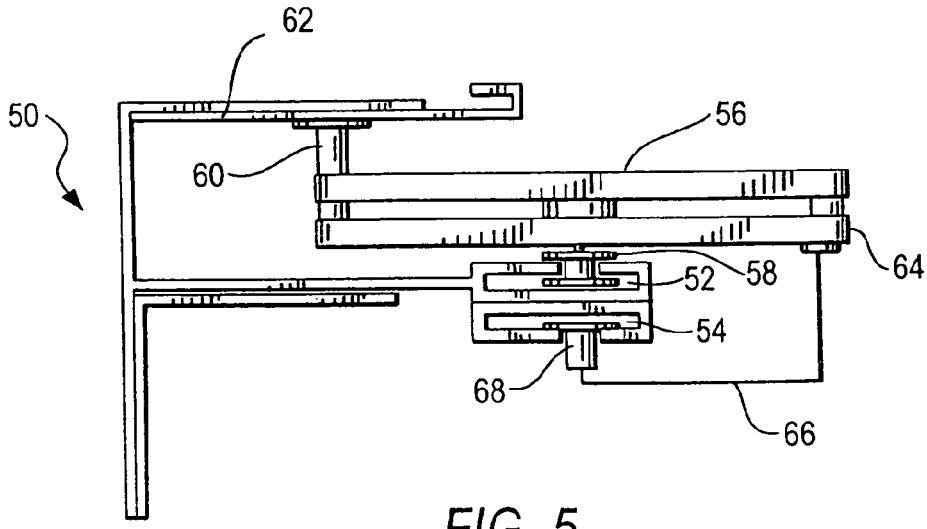
FIG. 5 is an end view of the headrail of the covering in accordance with a second embodiment of the invention.

Turning now to a second embodiment of the present invention, FIG. 5 is an end view of a headrail 50 taken from the right side of FIG. 1. As shown, headrail 50 is assembled from extruded aluminum members, although it may alternatively be integrally extruded from aluminum or plastic.

Headrail 50 comprises an upper rail 52 and a lower rail 54, both of which are essentially channels one above the other, upper rail 52 facing upward and lower rail 54 facing downward. Upper rail 52 accommodates a pantograph 56 whose central links each have a wheel 58 having flanges which maintain wheel 58 within upper rail 52. Within headrail 50, the inboard links of the pantograph 56 include sliders 60 which keep the pantograph 56 level by contacting the inner surface of horizontal member 62. Selected outboard links, such as outboard link 64, are connected by a horizontal wire 66 to a wheel 68 disposed in the lower rail 54. Wheel 68, too, has a flange which keeps it within lower rail 54. Wheel 68 is farther from the viewer of FIG. 5 than outboard link 64. As a consequence wire 66 is oriented diagonally away from the viewer from outboard link 64 to wheel 68.

Wires 66 are used to hang or suspend panels 14 in this second embodiment. As such, the panels 14 may be folded over the wires 66 and secured therearound. Alternatively, the panels 14 may be attached to the wires 66 at one central point, at the two corners, or by any other arrangement that may occur to one of ordinary skill in the art. In any event, the weight of the panels 14 would tend to rotate the pantograph 56 in a clockwise direction in the view presented in FIG. 5, thereby making it necessary to provide sliders 60 to maintain the pantograph 56 in a level condition.

As mentioned above, selected outboard links 64 have wires 66 which run therefrom to a wheel 68 running in lower rail 54. The number of such outboard links 64 depends upon the number and width of panels 14. It may be, for example, that every fifth outboard link 64 would be provided with such a wire 66, so that, when the covering 10 is fully opened and the pantograph 56 collapsed, the panels 14 would be overlappingly stacked with a stacking distance of 1.0 inch, and so that, when the covering 10 is fully closed and the pantograph 56 extended, the panels 14 would overlap one another by only a small amount so that the covering 10 would completely block the opening before which it is installed. Wand 18 is suspended from an outboard link 64 of the pantograph 56 adjacent to the endmost panel 14.

It will be recognized by those of ordinary skill in the art having some familiarity with pantographs that, when the pantograph 56 is fully collapsed, the covering 10 then being fully opened, panels 14 will be overlappingly stacked at one end of headrail 50 and oriented parallel to one another at some angle relative to the longitudinal direction of the headrail 50. As the covering 10 is closed, the panels 14, except for that at the leftmost or rightmost end, move progressively and in unison across the headrail 50, making gradually a smaller and smaller angle relative to the longitudinal direction thereover as the pantograph 56 becomes fully extended. As a consequence, the gaps visible when viewing the closed covering of the first embodiment of the present invention from the side are smaller in this second embodiment.

As implied above, the panel 14 at the leftmost or rightmost end of the covering 10 remains relatively at rest as the covering 10 is being opened or closed. This is so because it is attached only to the initial outboard end of the pantograph 56, that end being adjacent to the first central link thereof which is fixed on the headrail 50. As a consequence, movement of the pantograph 56 does little more than change the angle of that panel 14 relative to the longitudinal direction of the headrail 50.

It should be understood, then, that the slight change in angular orientation relative to the longitudinal direction of the headrail 50 made by the panels 14 when the covering 10 is being opened or closed results from the extension or collapse of the pantograph 56 and from the manner in which the wires 66, from which the panels 14 are suspended, are attached thereto. It should be further understood that the panels 14 are fixedly attached to their respective wires 66 in a manner not permitting rotation relative to the wires 66. In other words, individual panels 14 cannot be rotated about their vertical axes when the covering 10 is stationary, such as when it is fully closed, and do so only slightly when the covering 10 is being moved between an opened and closed condition, or vice versa.

Figure 6:
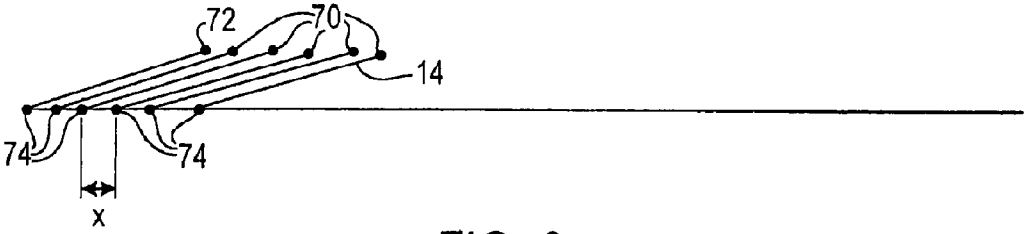
FIG. 6 is a schematic view from above of the spatial relationship among the panels of the covering of the second embodiment when fully opened.
Figure 7:
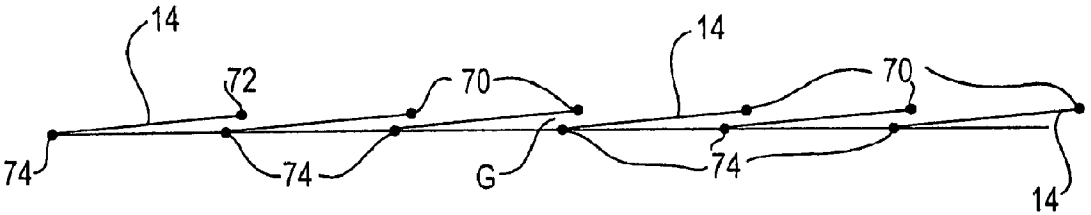
FIG. 7 is a schematic view from above of the spatial relationship among the panels of the covering of the second embodiment when fully closed.

The slight angle change made by the panel 14 is illustrated schematically in FIGS. 6 and 7. FIG. 6 is a schematic view of the relative spatial relationship among the panels 14 when the covering 10 of this second embodiment is in a fully opened condition. Panels 14 are overlappingly stacked at the left side of the figure; the stacking distance "X" being indicated. Rear corners 70 of the panels 14 are connected, in the manner described above, to selected outboard links of the pantograph 56, not shown in FIGS. 6 and 7, while rear corner 72 of the leftmost panel 14 is connected to the final link of the pantograph 56 adjacent to the central link where the pantograph 56 is fixed in the headrail 50 and from which it extends and collapses. As such, the leftmost panel 14 moves minimally as the covering 10 is being opened and closed, that motion primarily being a change of angular orientation relative to the headrail 50. The front corners 74 of the panels 14 are all connected, in the manner described above, to wheels 68 disposed in lower rail 54, so that as the pantograph 56 is extended or collapsed, the front corners 74 of the panels 14 slide along the lower rail 54 of the headrail 50, the leftmost panel 14 doing so only minimally because the final outboard link thereof moves only minimally in the direction of the headrail 50 as the pantograph 56 is being extended or collapsed.

FIG. 7 is a schematic view of the relative spatial relationship among the panels 14 when the covering 10 of this second embodiment is in a fully closed condition. Panels 14, because pantograph 56, not shown, is fully extended, are inclined more closely to the longitudinal direction of the headrail 50 and are separated by a much smaller gap G when viewed from the side, compared to the fixed gap characteristic of the first embodiment discussed above. Leftmost panel 14 is in almost the same position in FIG. 7 as it is in FIG. 6, the difference being only a change in angular orientation matching that of the other panels 14.

Figure 8:
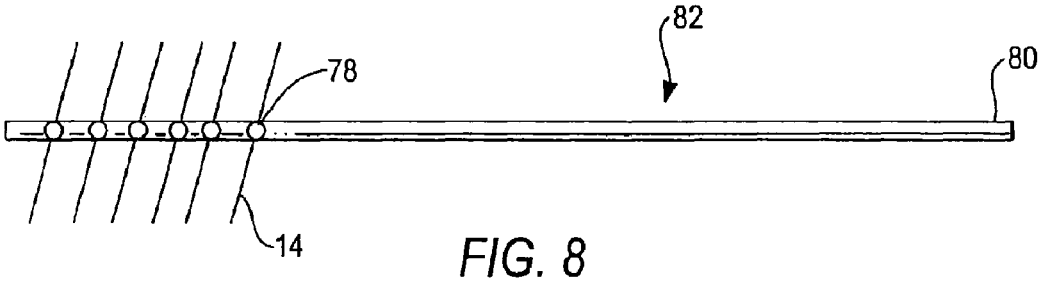
FIG. 8 is a schematic view from above of a third embodiment of the covering of the present invention when opened.
Figure 9:
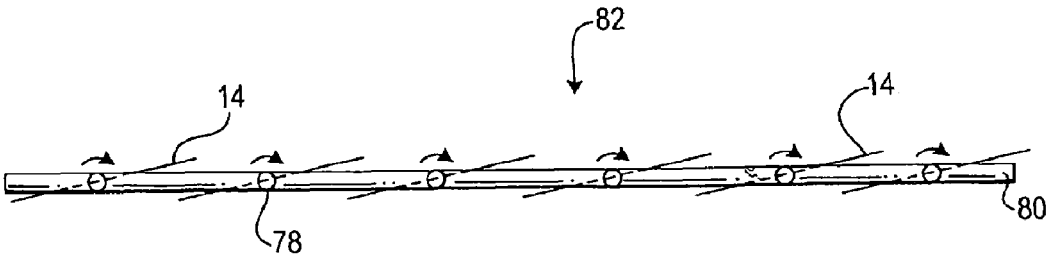
FIG. 9 is a schematic view from above of the covering of the third embodiment when fully closed.

In a third embodiment of the present invention, illustrated schematically in FIGS. 8 and 9, panels 14 are suspended from a single point on spring-biased couplings from a headrail. Referring first to FIG. 8, spring-biased couplings 78 are slidingly mounted on headrail 80 in a schematic view from above. Panels 14 are suspended below headrail 80 from spring-biased couplings 78, which may be translated across the headrail 80 by any of the means used by those of ordinary skill in the art to do so for the slots of a vertically hanging blind.

In accordance with this third embodiment of the present invention, spring-biased couplings 78 rotate panels 14 in a clockwise sense as viewed from above in the schematic view given in FIG. 9. As the covering 82 is being closed by drawing the spring-biased couplings 78 to the right in FIG. 9, the panels 14 rotate in the direction indicated therein when given the space to do so as they move to the right. When the covering 82 is fully closed, the panels 14 block the architectural opening completely from the view of one positioned in front, as one panel overlaps the next by a small amount. Moreover, little gap is presented to the viewer standing at an angle as the panels 14 ultimately close against one another.

As noted above, at the bottom of each panel 14 is a bar 16 which extends for the width of the panel. In addition to keeping the panels 14 taut, because of their weight and stiffness, the bars 16 keep the panels from entangling with one another when the covering 10 is being opened and closed. Moreover, the bars 16 are linked, one to the next, to ensure that the panels 14 will be parallel to one another when the covering is fully opened and fully closed so that it will present a pleasing appearance.

There are at least two ways to link the panels 14 together; others may occur to those of ordinary skill in the art.

Figure 10:
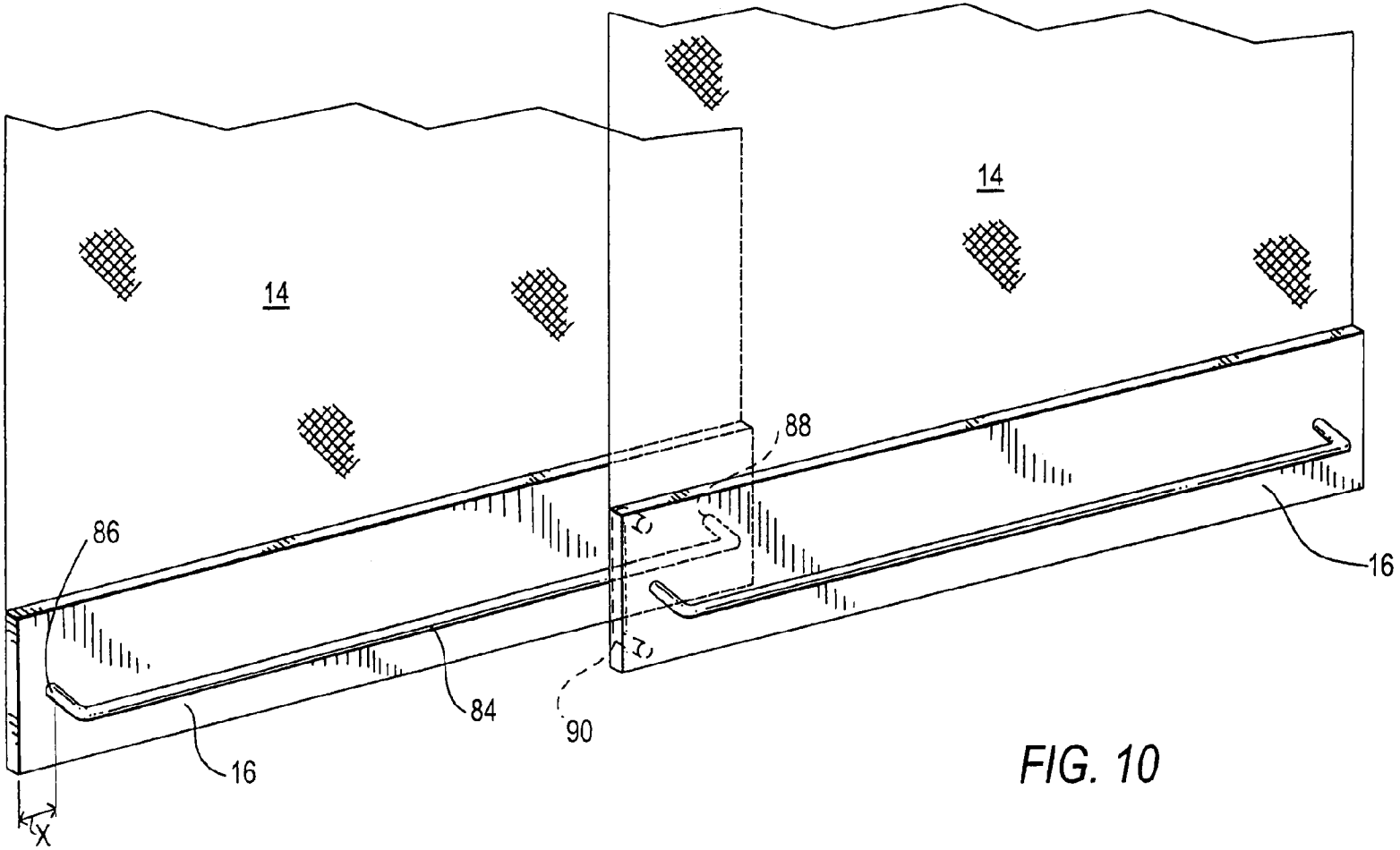
FIG. 10 is a perspective view, partly in phantom, of the rear side of two adjacent panels of the covering showing a first means for linking them together.

FIG. 10 is a perspective view, partly in phantom, of the rear side of two adjacent panels 14, the rear side being that facing the architectural opening before which the covering 10 is disposed. On the rear side of the bar 16 is a wire 84 which extends parallel to the surface thereof between two points 86, 88, each a short amount from the end of the bar 16. On the front side of the bar 16 of the adjacent panel 14 is a guide loop 90 through which wire 84 passes. Wire 84 and guide loop 90 link the two panels 14 together. In addition, when the covering 10 is fully opened, guide loop 90 abuts wire 84 at point 86, point 86 being in from the edge of the panel 14 by an amount equal to the stacking distance X. This abutment keeps the panels 14 hanging parallel to one another when the covering 10 is fully opened. In like manner, guide loop 90 is abuts wire 84 at point 88 when covering 10 is fully closed, point 88 being in from the edge of panel 14 by an amount equal to that by which the panels 14 overlap when fully closed. This latter abutment keeps the panels 14 hanging parallel to one another when the covering 10 is fully closed.

Figure 11:
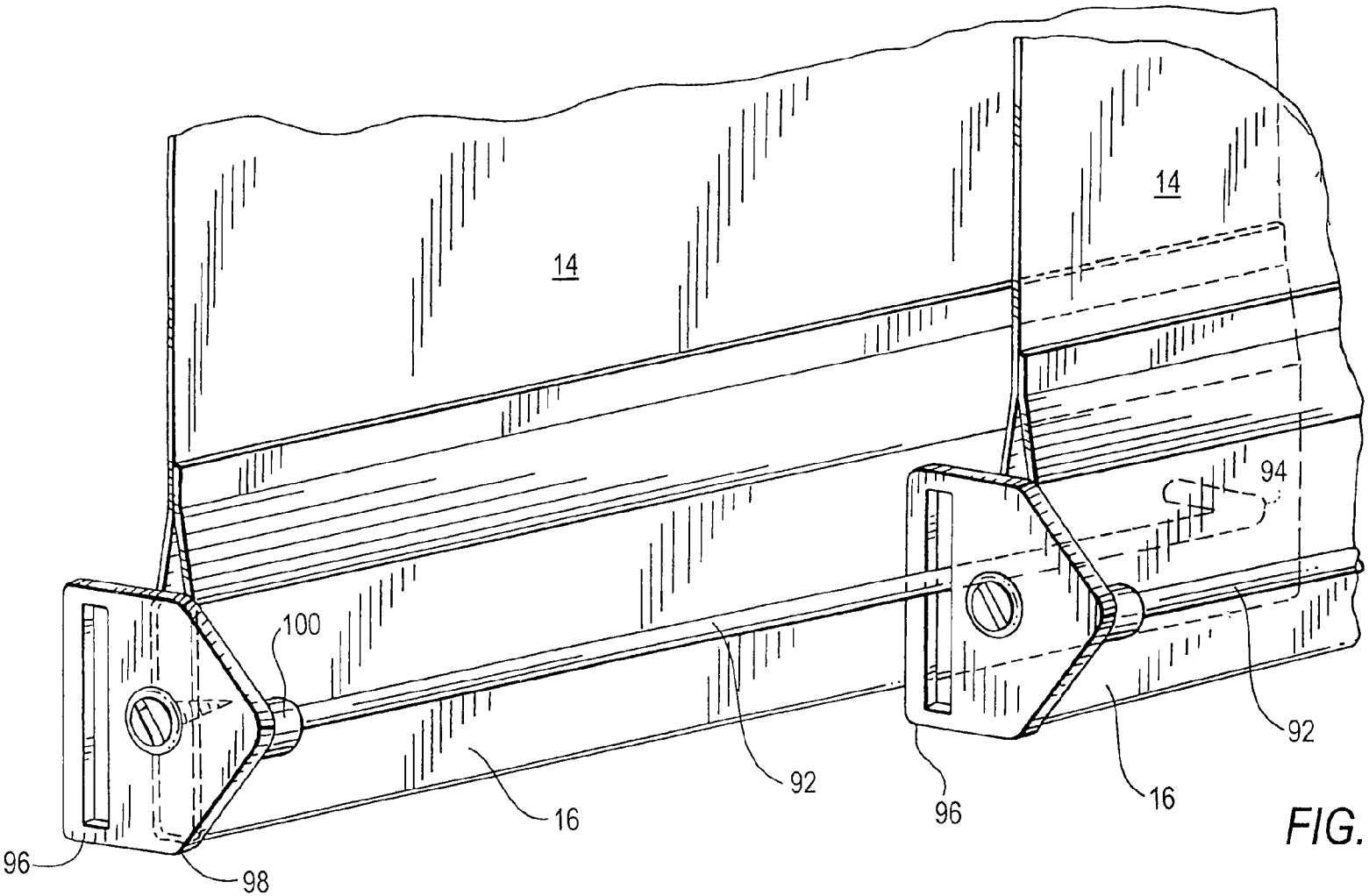
FIG. 11 is a perspective view, partly in phantom, of a variation of the means for linking shown in FIG. 10.

FIG. 11 is a perspective view, also partly in phantom, of the rear side of two panels 14 in a variation of the embodiment shown in FIG. 10. Bar 16 has a wire 92 which terminates at point 94 on the rear side of bar 16. Guide loop 96 is attachment to the end of bar 16, and includes an extension 98 which couples to wire 92 at stop 100. As above, guide loop 96 abuts stop 100 when the covering 10 is completely open to maintain the panels 14 in an aesthetically pleasing parallel relationship. Similarly, guide loop 96 abuts the end of wire 92 at point 94 when the covering 100 is fully closed to keep the panels 14 hanging parallel to one another in that condition.

Figure 12:
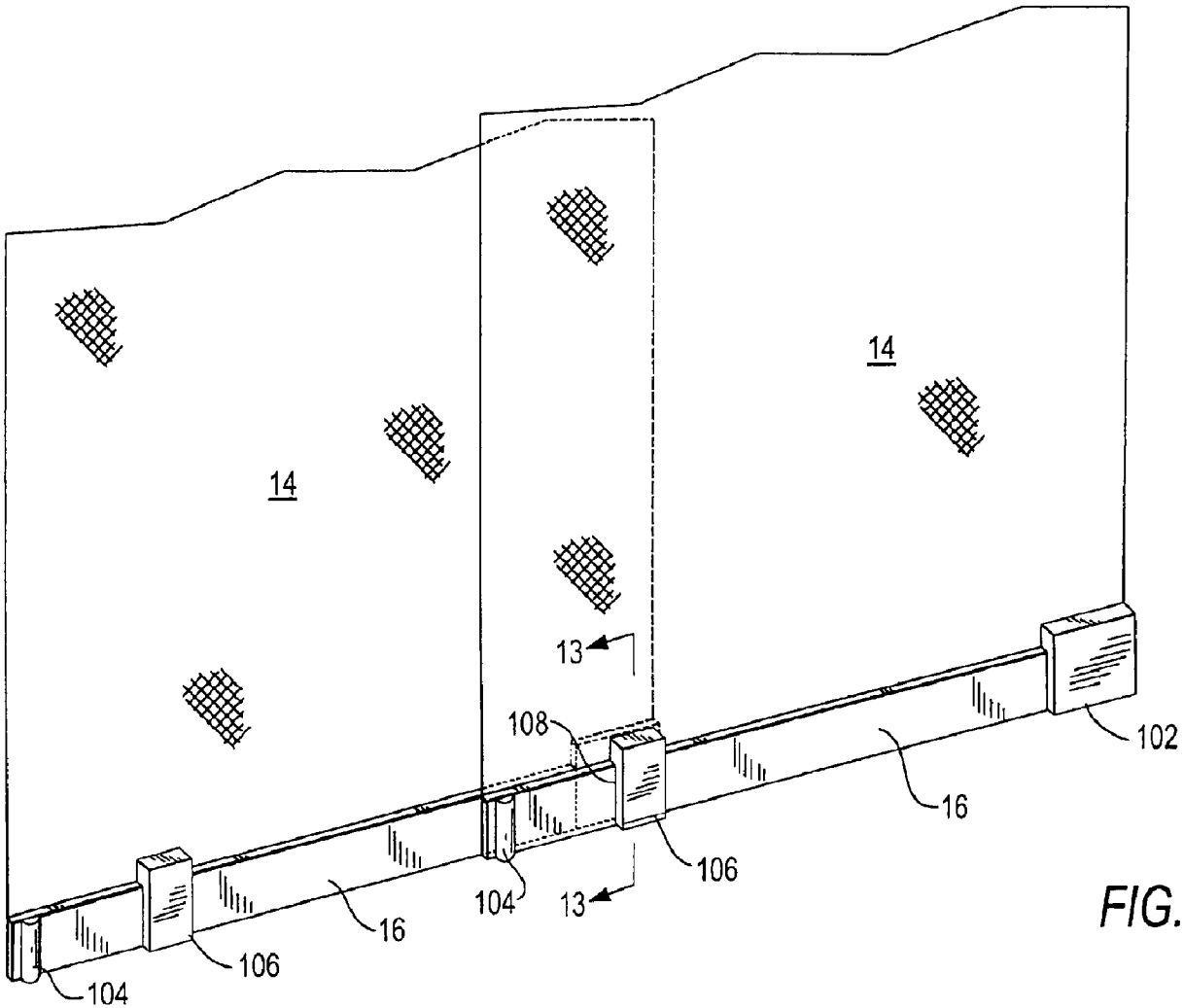
FIG. 12 is a perspective view, partly in phantom, of the rear side of two adjacent panels of the covering showing a second means for linking them together.
Figure 13:
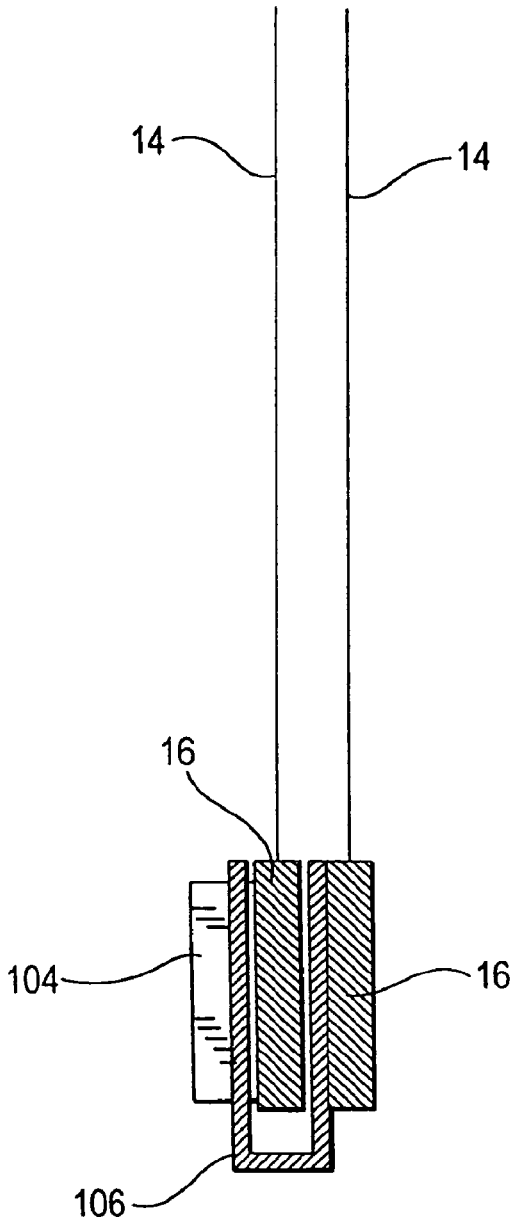
FIG. 13 is a cross-sectional view taken as indicated in FIG. 12.

FIGS. 12 and 13, the latter of which is a cross-sectional view taken as indicated in FIG. 12, show an alternate approach for linking the panels 14 together. FIG. 12 is a perspective view, partly in phantom, of the rear side of two adjacent panels 14, the rear side again being that facing the architectural opening before which the covering 10 is disposed. Rightmost panel 14 in FIG. 12 is the end panel which remains essentially stationary as the covering is opened or closed. At the outermost end of bar 16 of rightmost panel 14 is a stop 102, and at the opposite end of the bar 16 on each panel 14 is a stop 104. Finally, bar 16 for each panel 14, except the rightmost panel 14, has a channel 106, one of which is shown in phantom in FIG. 12 and in cross section in FIG. 13. Channels 106 are disposed at the opposite ends of bars 16 from stops 104.

Stops 102, 104 and channels 106 function in the following manner Firstly, as shown most clearly in FIG. 13, channel 106 is open at the top so that bar 16 may be readily removed therefrom to separate the panels 14 from one another should there be a need to do so. Secondly, when the covering is fully closed, stops 104 abut against channel 106 on the bar 16 of an adjacent panel 14 at cut-out point 108 to ensure that panels 14 are parallel to one another when the covering is fully closed. Finally, when the covering 10 is fully opened, channels 106 on each bar 16 abut against one another and against stop 102 so that overlappingly stacked panels 14 are parallel to one another at a desired stacking distance equal to the longitudinal length of the channel 106 and present a pleasing appearance when the covering is fully opened.

Figure 14:
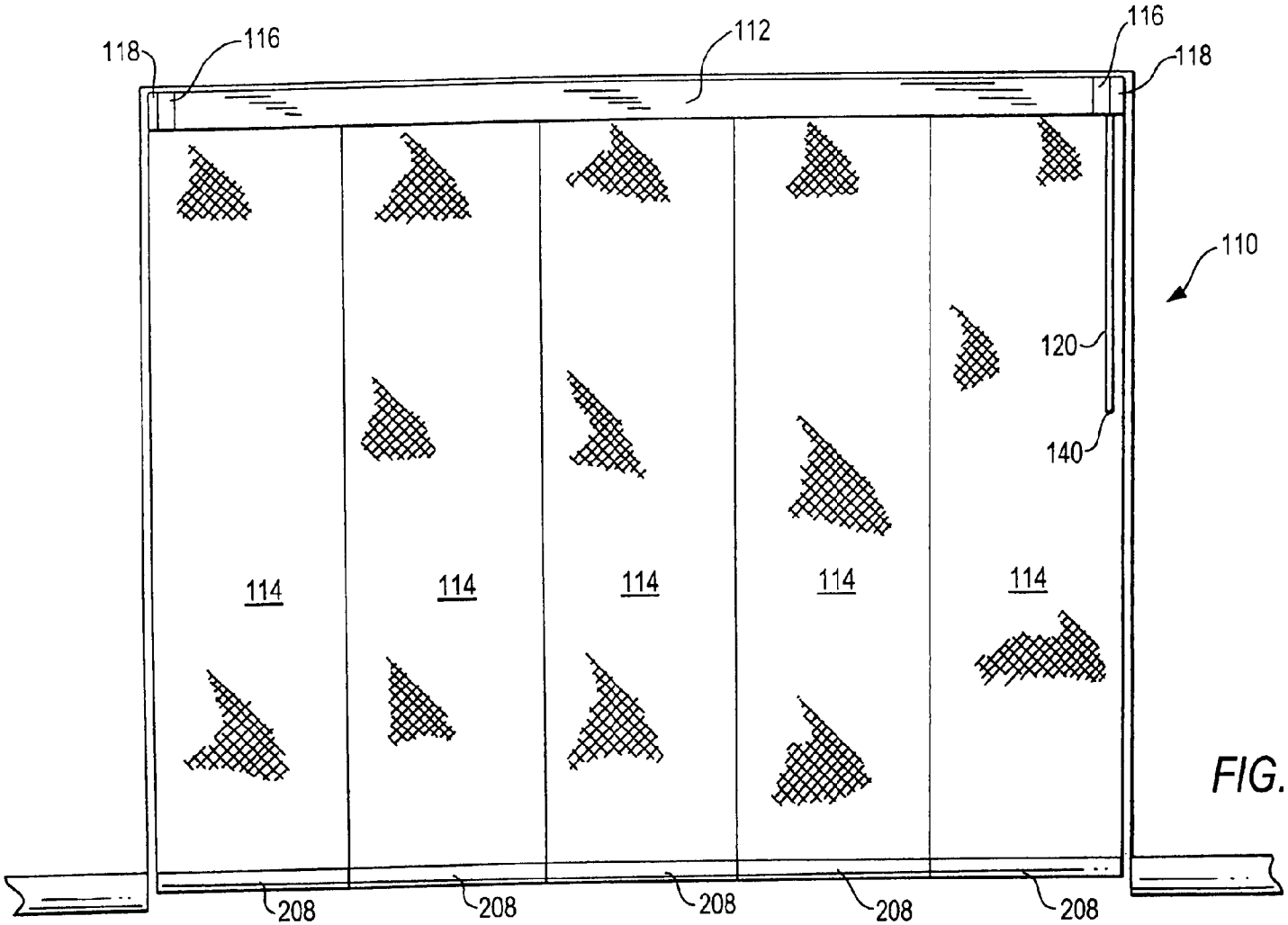
FIG. 14 is an elevational view of a fourth embodiment of the present invention.

A fourth embodiment of the present invention is shown in FIGS. 14 through 34. FIG. 14 is an elevational view of a covering 110 for an architectural opening. As shown in FIG. 14, the covering 110 includes a headrail 112, by which it may be mounted or suspended across the top of an architectural opening. The architectural opening shown in FIG. 14 is a window or sliding door of essentially floor-to-ceiling height. However, this should not be understood by the reader to limit the present invention to coverings 110 used in architectural openings of that type, for it is equally applicable to windows and doors of all heights and widths.

The covering 110, as shown in FIG. 14, comprises a plurality of individual panels 114 suspended from the headrail 112. When the covering 110 is opened, the panels 114 form a stacked array on the left-hand side of the architectural opening. However, there is no intention to limit the present invention in this respect, as the covering 110 may alternatively, be fashioned to form a stacked array on the right-hand side of the architectural opening when it is opened. As in the first embodiment discussed above, the panels 114 are oriented at a fixed oblique angle relative to the longitudinal direction of the headrail 112.

At each end of the headrail 112 is a cord-guiding member 116, whose structure and function will be described in complete detail below, and an end cap 118. Suspended from between the cord-guiding member 116 and end cap 118 at the right-hand end of the headrail 112 in FIG. 14 is a loop 140 of cord 120, which is used to open and close the covering 110.

Figure 15:
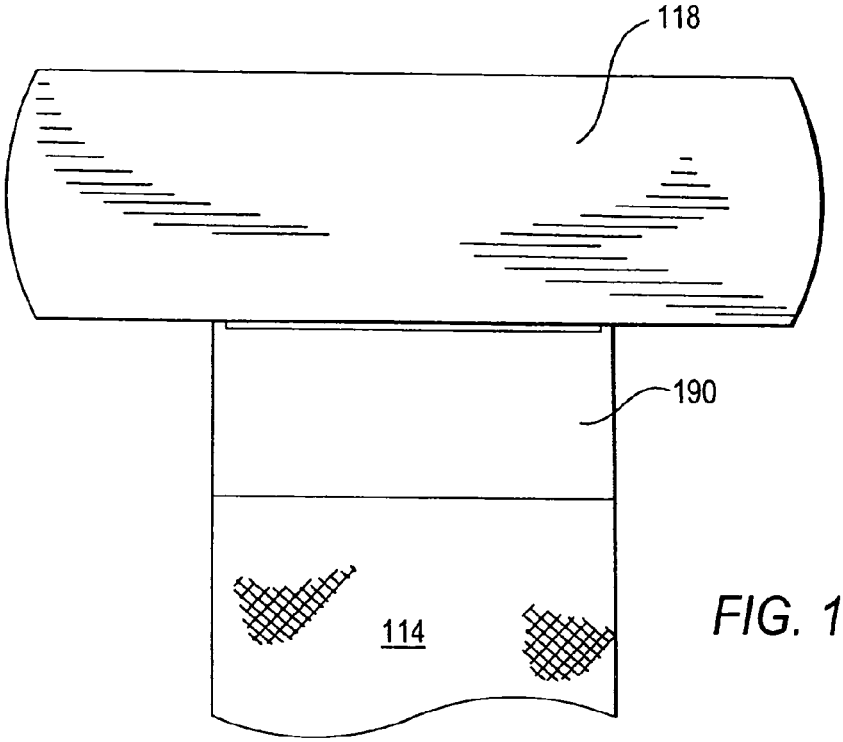
FIG. 15 is an elevational view thereof taken from the left end in FIG. 14.

FIG. 15 is an elevational view of the covering 110 taken from the left-hand end thereof in FIG. 14. End cap 118 covers the cord-guiding member 116; a portion of the leftmost panel 114 in FIG. 14 is shown hanging below, and is oriented, as noted above, at an oblique angle with respect to the longitudinal direction of the headrail 112, such that the side of panel 114 seen in FIG. 14 is visible, albeit viewed at a steep angle. When end cap 118 in FIG. 15 is removed, cord-guiding member 116 appears as shown in FIG. 16.

As seen in the elevational view of FIG. 16, cord-guiding member 116 has two holes 122 within which may be screws 124 or the like used to attach cord-guiding member 116 to the headrail 112, as will be shown further below. A further hole 126 may be provided in cord-guiding member 116, so that screw 128 or the like may be disposed therein and used to immobilize the leftmost panel 114 in FIG. 14 at the left-hand end of the headrail 112. As a consequence, panels 114 form a stacked array at that end of the headrail 112 when the covering 110 is opened.

Figure 16:
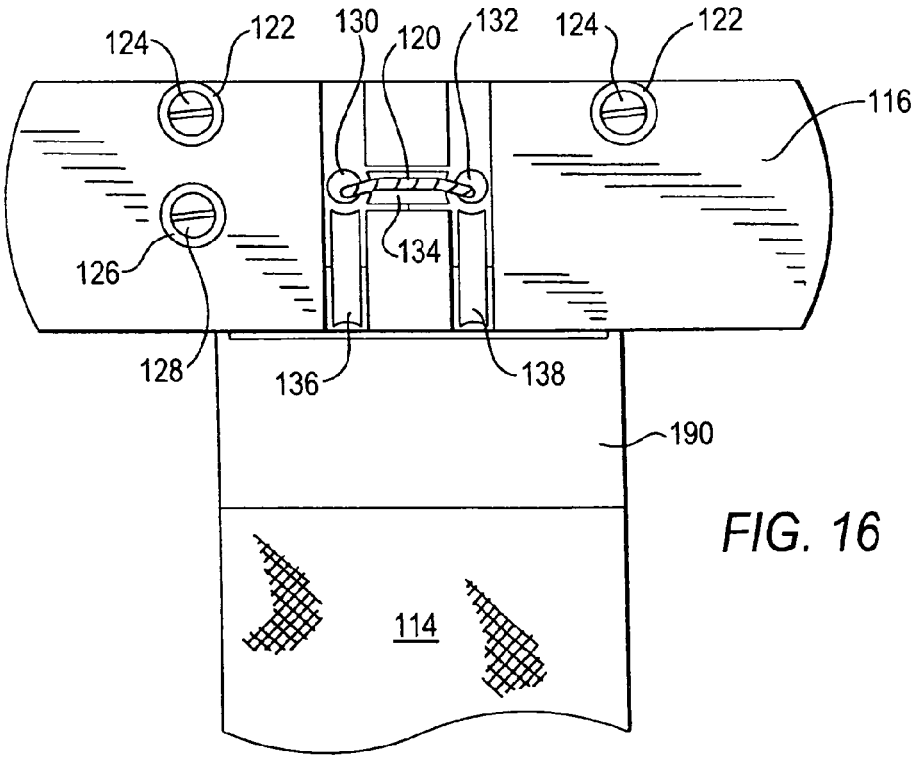
FIG. 16 is an elevational view after the removal of the end cap in FIG. 15.

Cord 120 in FIG. 16 passes outwardly from within headrail 112, which is not visible in FIG. 16, but rather is hidden by cord-guiding member 116, through hole 130 and re-enters through 132. Between holes 130, 132 is a roller 134, which may alternatively be a pulley. Roller 134, which is rotatable about a vertical axis, enables the cord 120 to pass readily out of hole 130 and into hole 132, or vice versa, when the loop 140 of cord 120 at the right-hand side of FIG. 14 is manipulated to open or close the covering 110.

The cord-guiding member 116 also has rollers 136, 138, which may alternatively be pulleys, disposed below holes 130, 132, respectively. The purpose of rollers 136, 138 will become clear in the discussion of FIG. 17 below.

Figure 17:
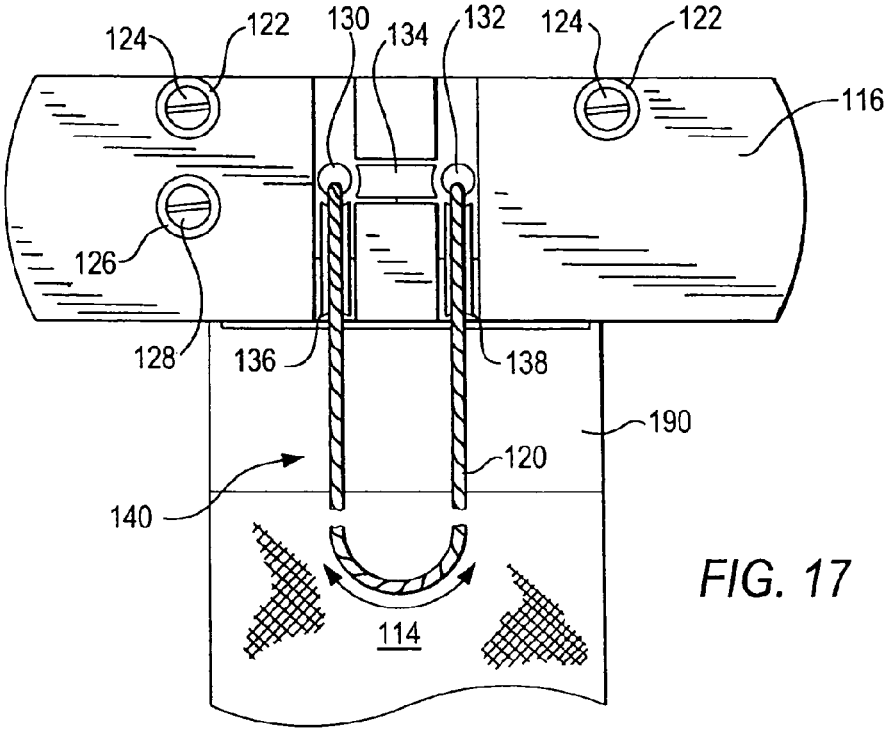
FIG. 17 is the view of FIG. 16 after the cord has been pulled out to form a loop.
Figure 19:
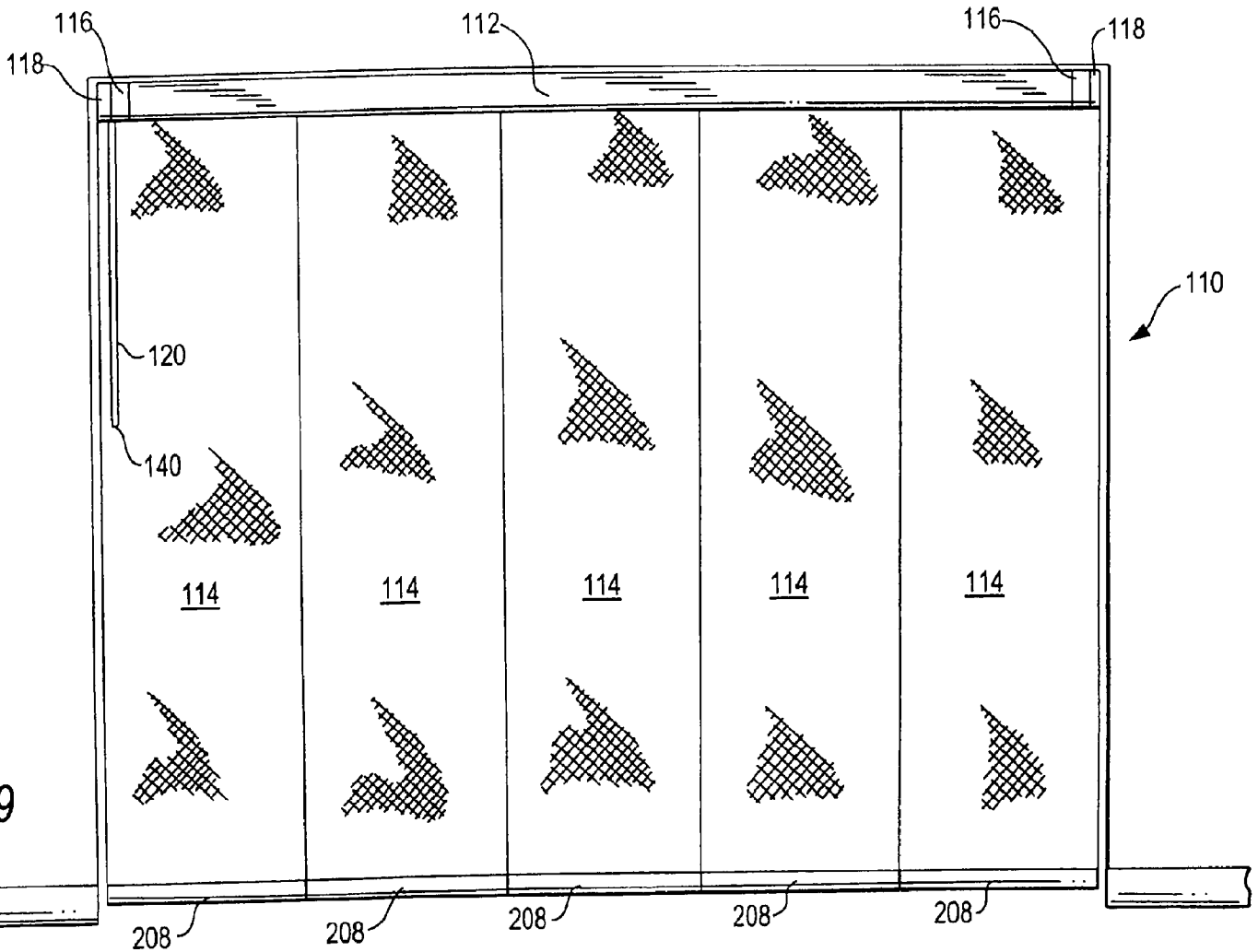
FIG. 19 is an elevational view of the fourth embodiment with the loop of cord on the left-hand side.

Cord 120, which loops around roller 134 in FIG. 16, may be grasped at roller 134 and pulled out through holes 130, 132 to produce the loop 140 shown in FIG. 17. In so doing, loop 140, originally appearing in FIG. 14 on the right-hand side of the covering 110 is "moved" to the left-hand side, ultimately giving the covering 110 the appearance it has in FIG. 19. In such a situation, rollers 136, 138 facilitate the manipulation of cord 120 using loop 140 to open and close the covering 110 from the left-hand side, as shown in FIG. 19. It should be understood that the cord-guiding member 116 at the right-hand end of the headrail 112 operates in the same fashion.

Figure 18:
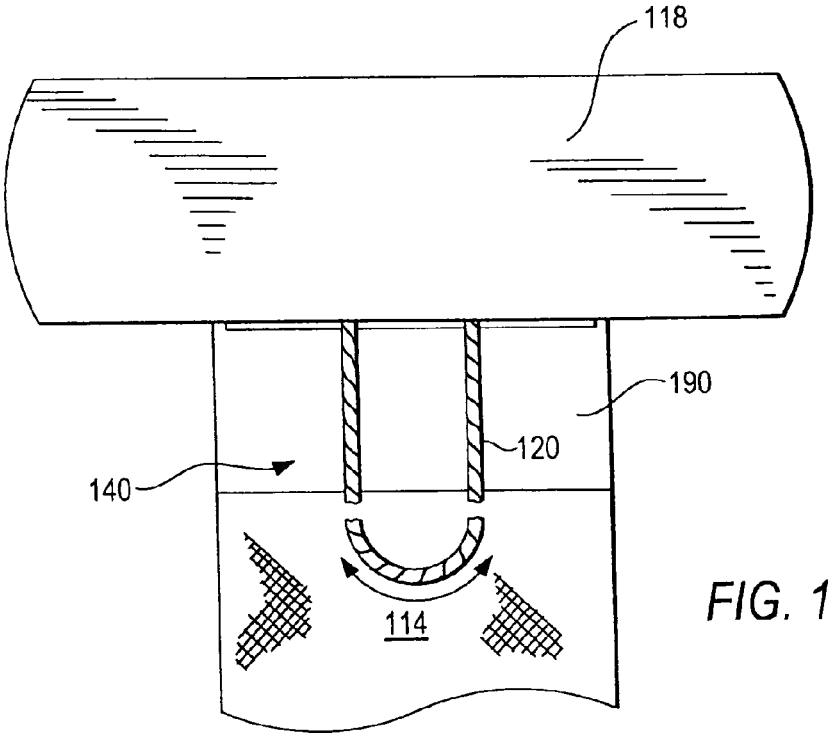
FIG. 18 is the view of FIG. 17 with the end cap replaced.

FIG. 18 is an elevational view of the covering 110 taken from the left-hand end thereof when the end cap 118 has been replaced over cord-guiding member 116 in FIG. 17.

Figure 20:
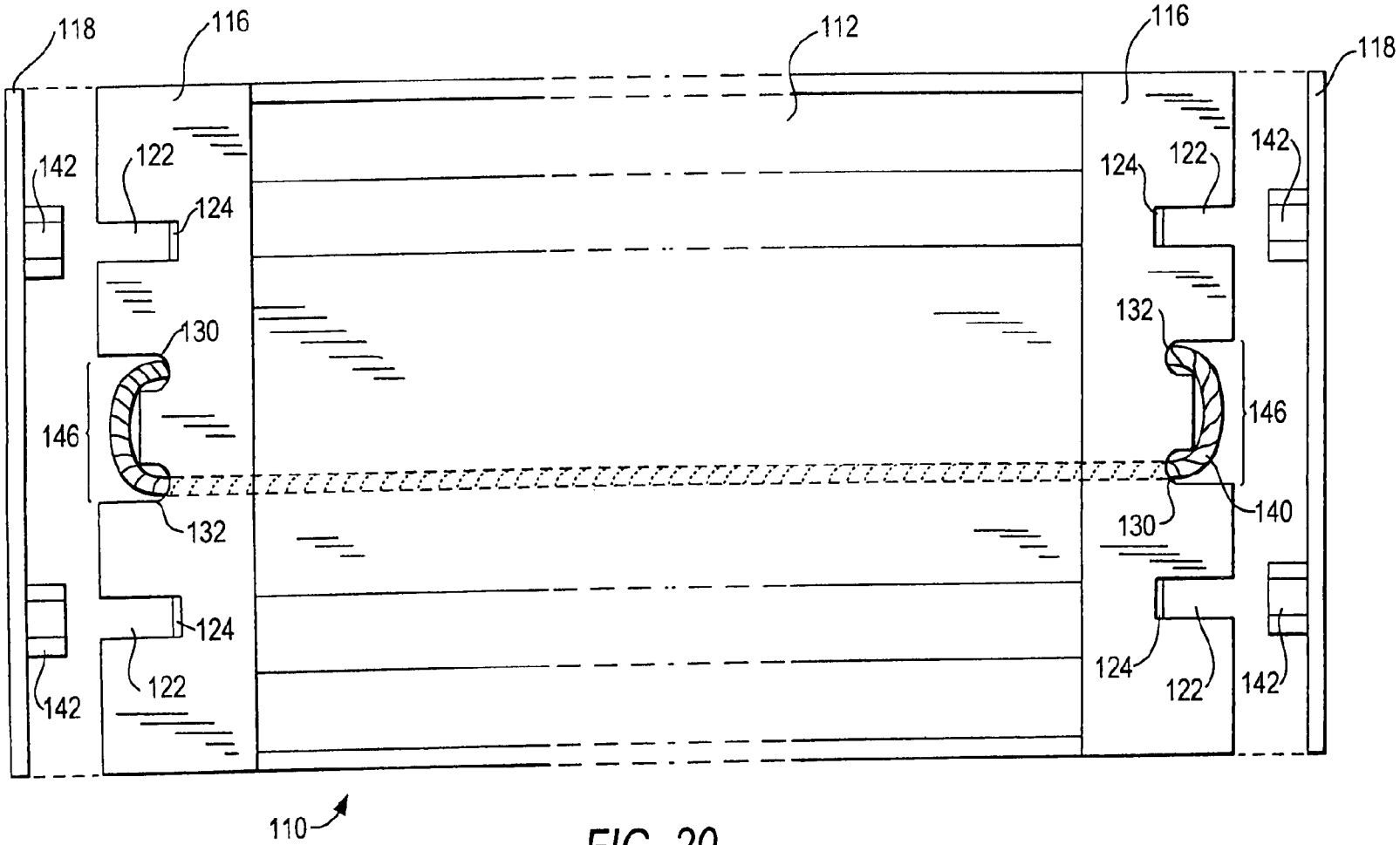
FIG. 20 is a view of the fourth embodiment taken from above.

FIG. 20 is a view of covering 110 taken from above the headrail 112 in FIG. 14 with the end caps 118 exploded from the cord-guiding members 116 at both ends of the headrail 112. As shown with phantom lines in FIG. 20, cord 120 has a portion which runs within headrail 112 directly from the left-hand end of the headrail 112 to the right-hand end, where it forms loop 140. One pulling at the cord 120 from the left-hand end can pull all of the cord 120 forming loop 140 through headrail 112 to "move" the loop 140 to the left-hand side. As will be discussed in more complete detail below, both ends of cord 120 are secured to a mechanism, not shown in FIG. 20, within headrail 112 directly controlling the movement of the plurality of panels 114 so that, when cord 120 is pulled in one direction, covering 110 is closed, and, when cord 120 is pulled in the other direction, the covering 110 is opened.

End caps 118 each have posts 142 which may be held within holes 122 in cord-guiding members 116 by interference fit to cover the cord-guiding members 116. Cord 120 emerges from within headrail 112 through holes 130, 132 in cord-guiding members 116. Holes 130, 132 are in recesses 146 as that, when end caps 118 are in place, cord 120 may be freely manipulated. Recesses 146 also provide room for a tool, such as a screwdriver, to be inserted between cord-guiding member 116 and end cap 118 to pry end cap 118 away from cord-guiding member 116 to gain access to cord 120 as shown in FIG. 16 to change the location of loop 140 from one end of the covering 110 to the other. As such, this embodiment of the present invention provides a straightforward and simple approach to changing the location of a cord loop used to operate a covering for an architectural opening without a complicated and time-consuming disassembly and without removal from above the architectural opening where it is installed.

Figure 21:
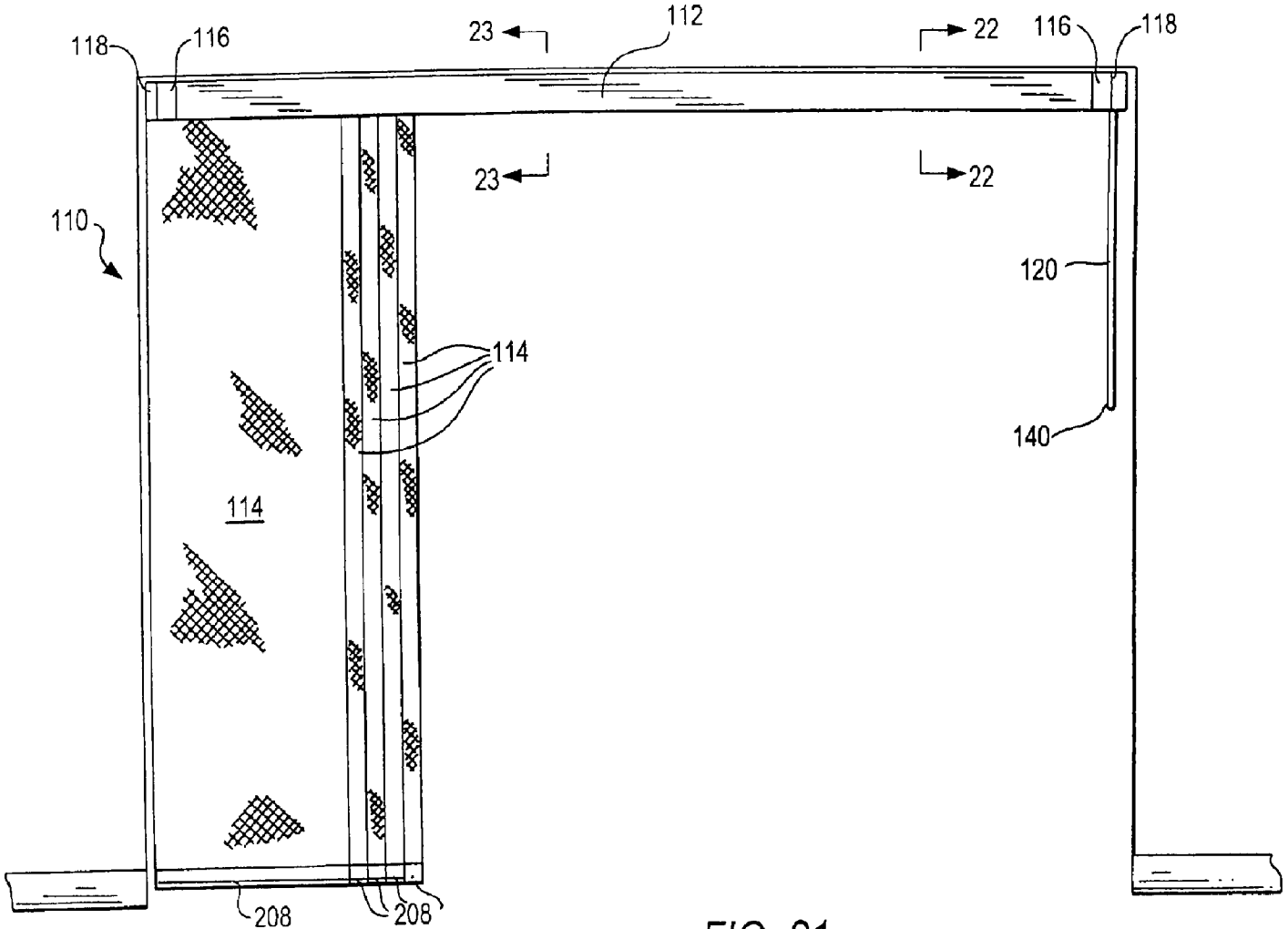
FIG. 21 is an elevational view of the fourth embodiment when fully opened.

Turning now to FIG. 21, the covering 110 as shown in FIG. 14 with the loop 140 of cord 120 on the right-hand side has been opened to produce an overlapped stack of panels 114 on the left-hand side of the architectural opening Except for the leftmost panel 114, which remains stationary or fixed, each panel 114 slides behind that to its left during the opening operation, extending outward some nominal amount, perhaps an inch or two, from behind that in front. Although not apparent in FIG. 14, panels 114 overlap, again by a nominal amount, perhaps an inch or two, from behind that in front. Although not apparent in FIG. 14, panels 114 overlap, again by a nominal amount, when the covering 110 is closed, so that no gaps are presented to an observer directly in front of the covering 110.

Figure 22:
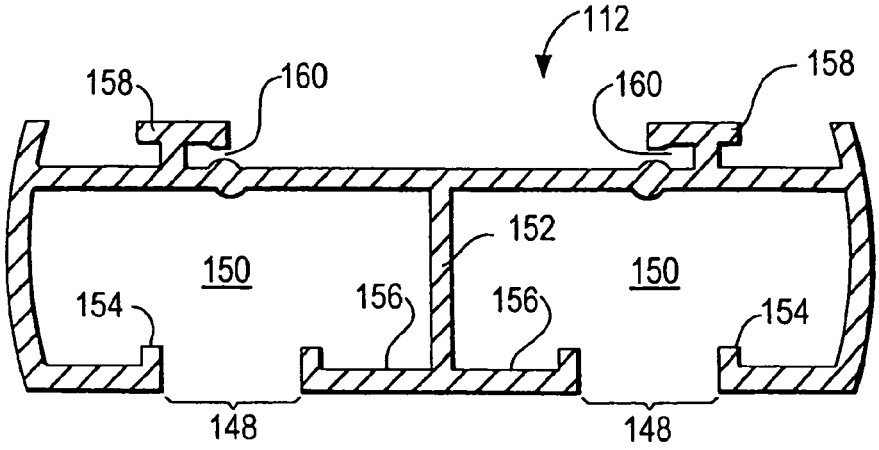
FIG. 22 is a cross-sectional view of the headrail of the fourth embodiment.

FIG. 22 is a cross-sectional view of headrail 112 taken as indicated in FIG. 21. Headrail 112, again constituting a single track, includes two rails 148. Associated with each rail 148 is an interior compartment 150, each compartment 150 being separated from the other by interior wall 152. Rails 148 are more particularly defined by flanges 154 which extend into interior compartments 150. Between interior wall 152 and each of rails 148 is a ledge 156. Referring to FIGS. 16 and 17, it will at once become apparent to the reader that ledges 156 align with holes 130, 132 in cord-guiding members 116, and that, as a consequence, ledges 156 support cord 120, omitted from FIG. 22 for the sake of clarity, within the headrail 112.

On the upper exterior of headrail 112 are flanges 158 by which it may be attached to appropriate hardware installed above an architectural opening for mounting purposes. In addition, there are channels 160 which the reader, again referring to FIGS. 16 and 17, will recognize to be aligned with holes 122 in cord-guiding members 116. Screws 124 or the like are driven into channels 160 to attach cord-guiding members 116 to the ends of headrail 112.

Figure 23:
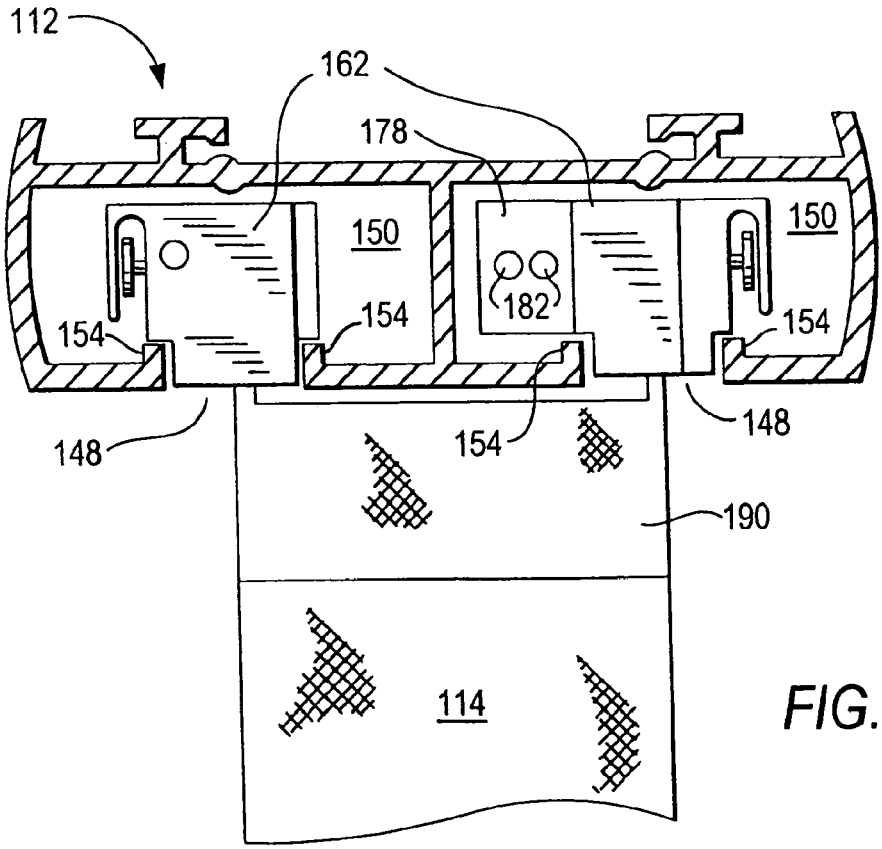
FIG. 23 is a cross-sectional view of the headrail taken in the opposite direction from that of FIG. 22.

FIG. 23 is a cross-sectional view of covering 110 taken as indicated in FIG. 21. Rightmost panel 114 in FIG. 21 is again viewed at a steep angle; this time, however, the side facing away from the vantage point of FIG. 21 is seen. Panel 114 is oriented at an oblique angle relative to the longitudinal direction of headrail 112, and, as a consequence, its left-hand side is closer to the viewer of FIG. 23 than its right-hand side.

Figure 24B:
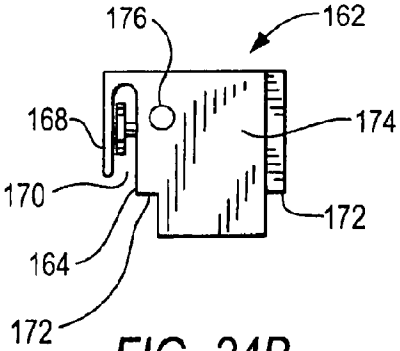
FIG. 24B is a view of one end of the carrier.

In each interior compartment 150, and slidable along rails 148 on flanges 154 are carriers 162, two of which, one in each rail 148, being required for each panel 114. A side view of a carrier 162 is provided in FIG. 24A. Two features are noteworthy in this view; on the left-hand side of face 164 is a screw 166, or the like, and a tab 168, whose functions will be described below. FIG. 24B is a view of the right-hand end of carrier 162 taken from the right in FIG. 24A, and is also the view shown of the carrier 162 in the left-hand rail 148 in FIG. 23. As may be seen in FIG. 24B, tab 168 is somewhat separated from face 164 by a gap 170. In addition, shoulders 172 run along the sides of carrier 162 so that they may be supported by flanges 154 and slided thereon along rails 148. Finally, end face 174 has a hole 176.

Figure 24D:
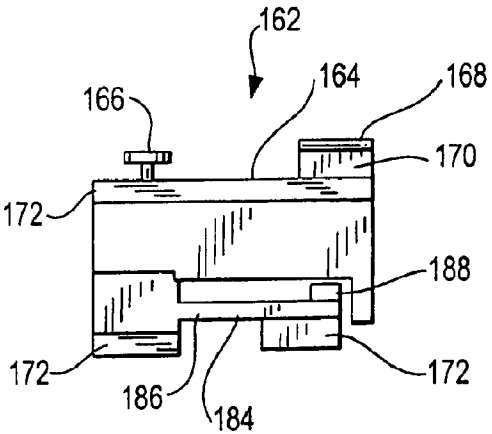
FIG. 24D is a view of the bottom of the carrier.
Figure 24A:
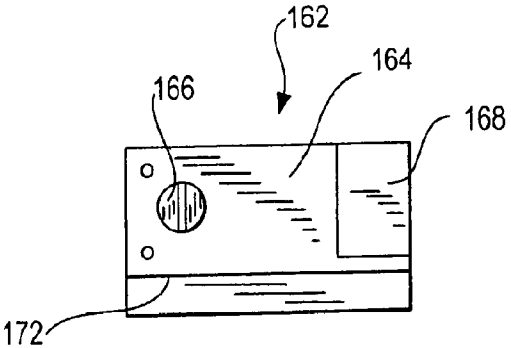
FIG. 24A is a side view of a carrier for the panels of the fourth embodiment.
Figure 24C:
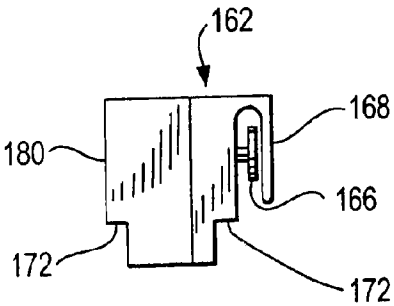
FIG. 24C is a view of the other end of the carrier.

FIG. 24C is a view of the left-hand end of carrier 162 taken from the left in FIG. 24A, and is also the view shown of the carrier 162 in the right-hand rail 148 in FIG. 23. It will be noted that carrier 162 on the right of FIG. 23 has an additional element, not included in FIGS. 24A through 24D, namely, a cord-securing member 178 secured to face 180. Although not shown in FIG. 23, for the sake of clarity, the two ends of cord 120, running from the left and right ends of headrail 112, respectively, terminate and are tied off at holes 182 in cord-securing member 178. When the cord 120 is appropriately manipulated at loop 140, cord-securing member 178 will move the carrier 162 to which it is attached one way or the other along headrail 112 to open or close the covering 110. Recalling that the view presented in FIG. 23 shows the carriers 162 for the rightmost panel 114, it should be understood that only carrier 162 in the right-hand rail 148 therein has a cord-securing member 178. All other carriers 162 have the appearance shown in FIGS. 24A through 24D. Of course, it will be recognized that a wand could alternatively be attached to carrier 162 in the right-hand rail 148, and the cord 120 eliminated, for use in opening and closing the covering 110.

Turning finally to FIG. 24D, a view of the bottom of carrier 162 taken from below in FIG. 24A, it will be noted that carrier 162 includes a latch mechanism 184 having a flexible arm 186 and a latching tab 188. Latch mechanism 184 enables panels 114 to be joined to carriers 162.

Figure 25:
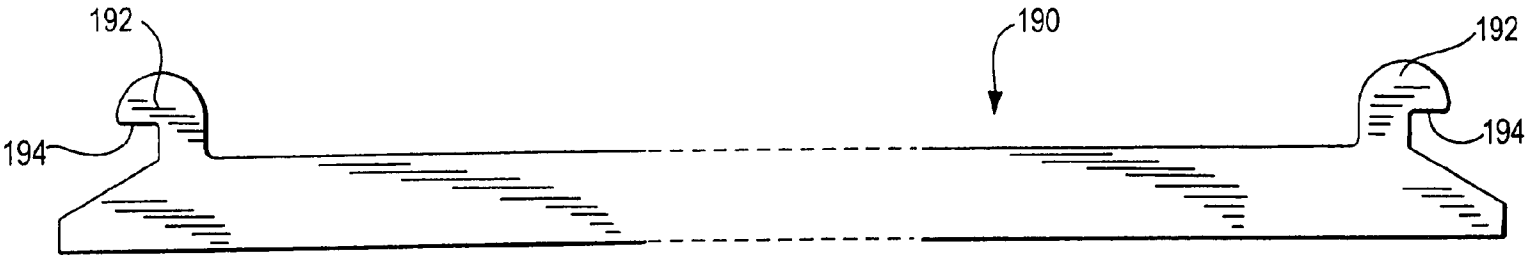
FIG. 25 is a plan view of a hanger for the panels in the fourth embodiment.

FIG. 25 is a plan view of a hanger 190, which may be of relatively inflexible metal or plastic sheet material. Hanger 190 may be of any desired length, depending primarily on the width of the covering 110 and on the number of panels 114 included therein. There is, in general, one hanger 190 per panel 114, and two carriers 162, one in each rail 140, for each panel 114. Panels 114 may be attached to hangers 190 using a strong adhesive, preferably on the side of hanger 190 away from the viewer within a room where the covering 110 is installed. Specifically, in FIGS. 15 through 18, panel 114 is attached to the side of hanger 190 not seen by the viewer, while, in FIG. 23, panel 114 covers hanger 190.

Returning to FIG. 25, hanger 190 has two oppositely facing hook-like members 192. To attach hanger 190 and panel 114 to carriers 162, the hook-like members 192 are inserted from below into latch mechanisms 184, wherein latching tabs 188 snap under flat portions 194 of hook-like members 192. That the carriers 162 in the two rails 148 are oriented in opposite directions, as clearly shown in FIG. 23 ensures that the hangers 190 are secured at opposite ends by carriers 162 in opposite rails 148.

Figure 26:
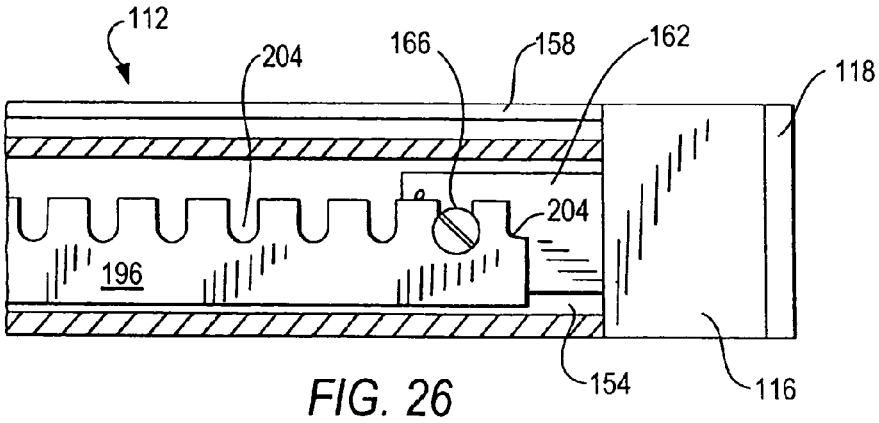
FIG. 26 is a cut-away view of the headrail from behind an end thereof.

FIG. 26 is a cut-away view of the headrail 112 taken from behind the left-hand end thereof in FIG. 14. Carrier 162 is stationary, as it is secured to cord-guiding member 116 by screw 128, or the like, in hole 126 in cord-guiding member 116 ultimately passing into hole 176 in carrier 162, as shown in FIG. 24B. Screw 166 is used to secure strap 196 to carrier 162.

Figure 27:
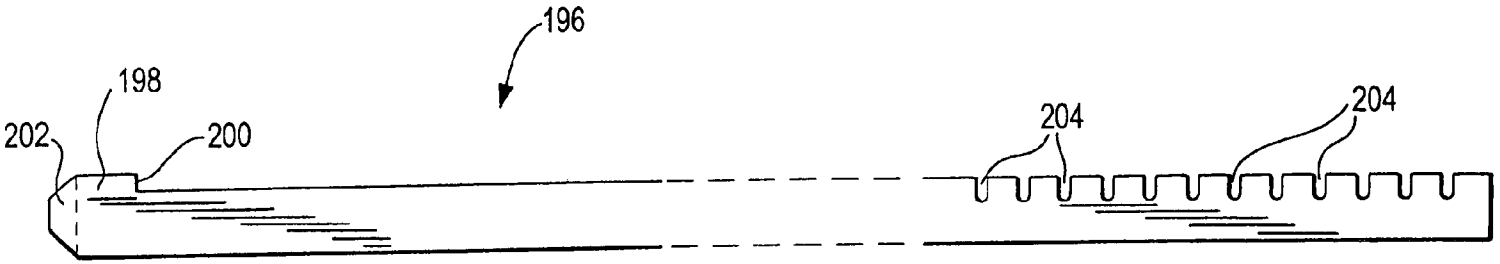
FIG. 27 is a plan view of a strap for linking panels together.

Strap 196 is shown in a plan view in FIG. 27. Strap 196 is a flexible strip of metal or plastic sheet, and is of uniform width except for an abruptly widened portion 198 beginning with step 200. A terminal portion 202 may be bent upward slightly from the plane formed by the strap 196 for a reason to be made clear below.

At the opposite end of strap 196 are a series of equally spaced notches 204. Straps 196 are the means by which the amount by which adjacent panels 114 overlap one another when the covering 110 is closed is established. For the moment, in connection with FIG. 26, it will be noted that strap 196 has been shortened relative to the view presented in FIG. 27, as a portion from a notch 204 to the end has been broken or cut off. Screw 166 is used to secure strap 196 to slider 162 at the last notch 204.

Figure 28:
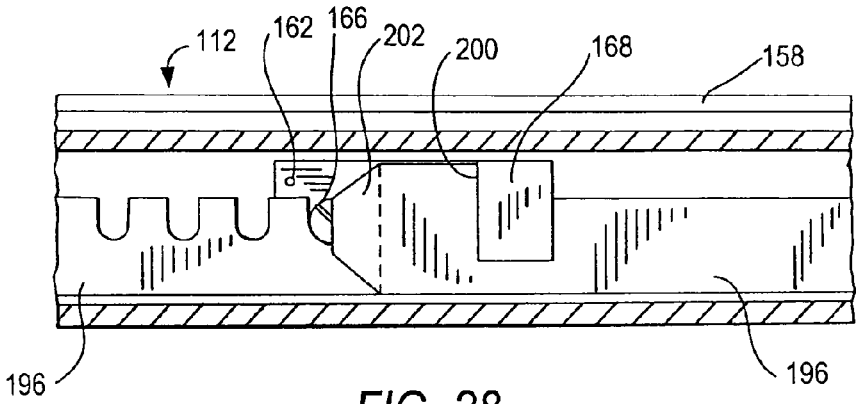
FIG. 28 is a cut-away view of the headrail from behind at a point where two panels overlap.

FIG. 28 is a cut-away view of the headrail 112 taken from behind at a point where two panels 114 overlap. Step 200 of right-hand strap 196 is shown caught behind tab 168, thereby preventing carrier 162 from moving any farther to the left. Left-hand strap 196 is attached to slider 162 in the manner shown in FIG. 26. It can now be seen in FIG. 28 that terminal portion 202 may be bent outward so as not to interfere with screw 166. In addition, such outward bending of terminal portion 202 will prevent strap 196 from interfering with tab 168 of another carrier 162.

Figure 29:
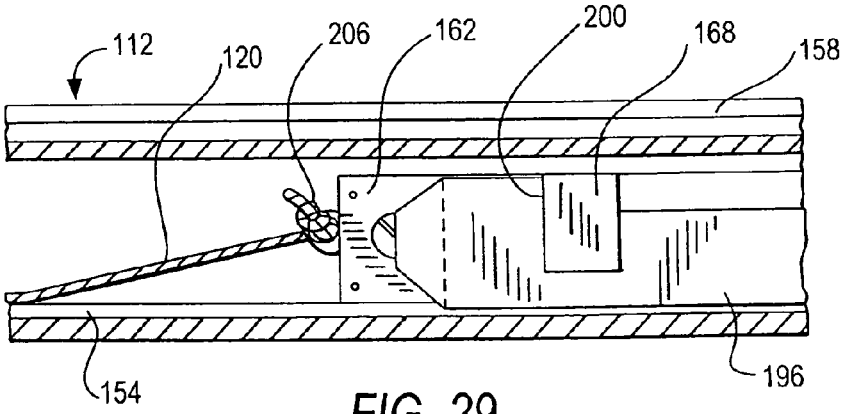
FIG. 29 is a cut-away view of the headrail from behind the rightmost panel.

FIG. 29 is a cut-away view of the headrail 112 taken from behind the rightmost panel 114 when the covering 110 is in the process of being closed. Cord 120 is at that point pulling carrier 162 toward the left in FIG. 29. Knot 206 is the tied-off end of cord 120 from the left-hand end of the covering as shown in FIG. 14. Carrier 162, being pulled by cord 120, in turn pulls the next carrier 162 to its right, not shown in FIG. 29, as step 200 of strap 196 engages behind tab 168 to link carrier 162 to the next.

Turning now to the characteristics of the bottom of covering 110, each panel 114 of the covering 110 shown in FIGS. 14, 19 and 21 is attached to a bottom rail 208 which provides sufficient weight to keep the panels 114 taut and hanging vertically and less susceptible to swaying with the slightest air movement. Moreover, bottom rails 208 enable the panels 114 to be connected to one another, as will be shown more particularly below, to dampen out any swaying motion and to provide a more pleasing appearance.

Figure 30:
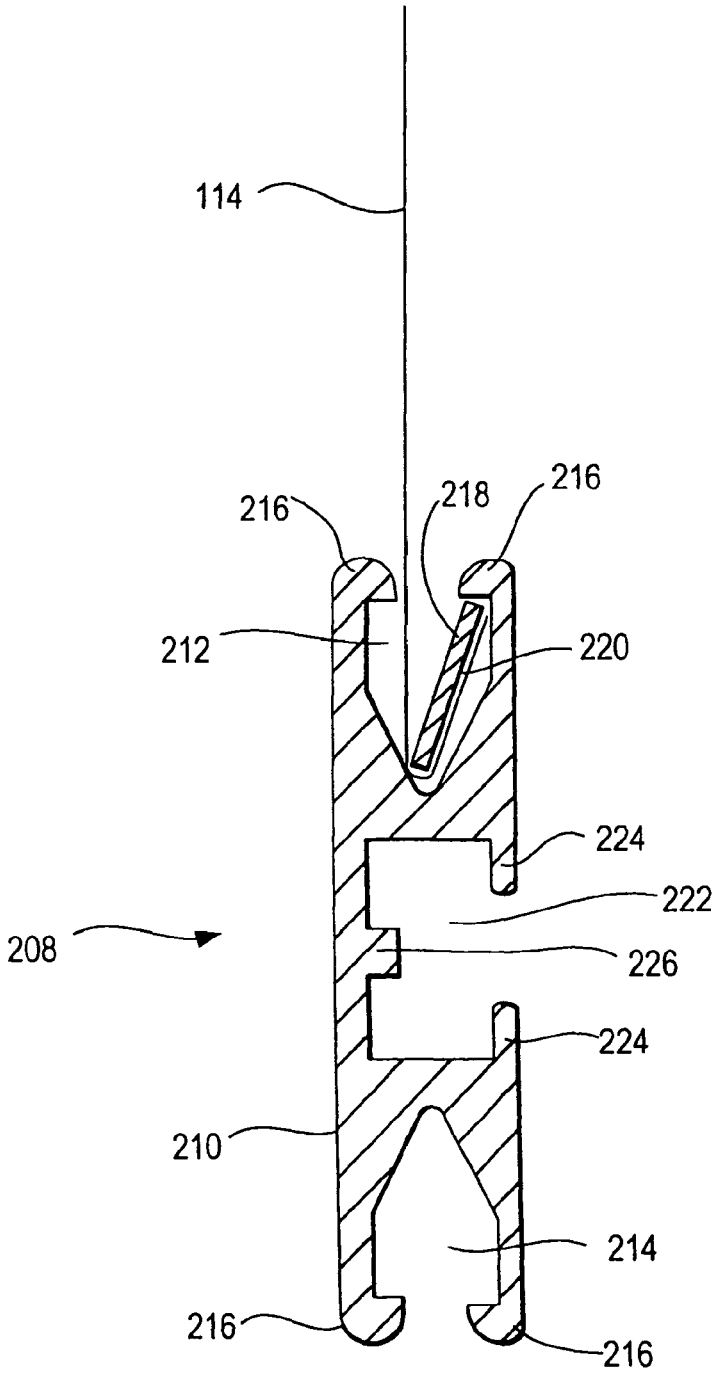
FIG. 30 is a cross-sectional view of a bottom rail showing the attachment of a panel thereto.

FIG. 30 is a cross-sectional view of the bottom rail 208 attached to any one of the panels 114. Bottom rail 208 has a smooth face 210, which faces the viewer of FIGS. 14, 19 and 21. Bottom rail 208 also has an upper V-shaped channel 212 and a lower V-shaped channel 214, each of which has hook-like members 216 extending toward one another at its opening.

Panel 114 is secured in upper V-shaped channel 212 with a strip 218 of plastic material, also seen in cross section in FIG. 30. Panel 114 extends downwardly into upper V-shaped channel 212, under strip 218 and around to the backside 220 thereof, where it may be secured by an adhesive. Hook-like member 216 prevents panel 114 and strip 218 from being pulled upwardly and out.

The rear side of bottom rail 208 has a channel 222 of generally rectangular cross-sectional shape. The channel 222 has a flange 224 on each side of its opening and a rail 226 within the channel and opposite to the flanges 224. Channel 222 is used in connecting each panel 114 to its neighbors.

Figure 31:
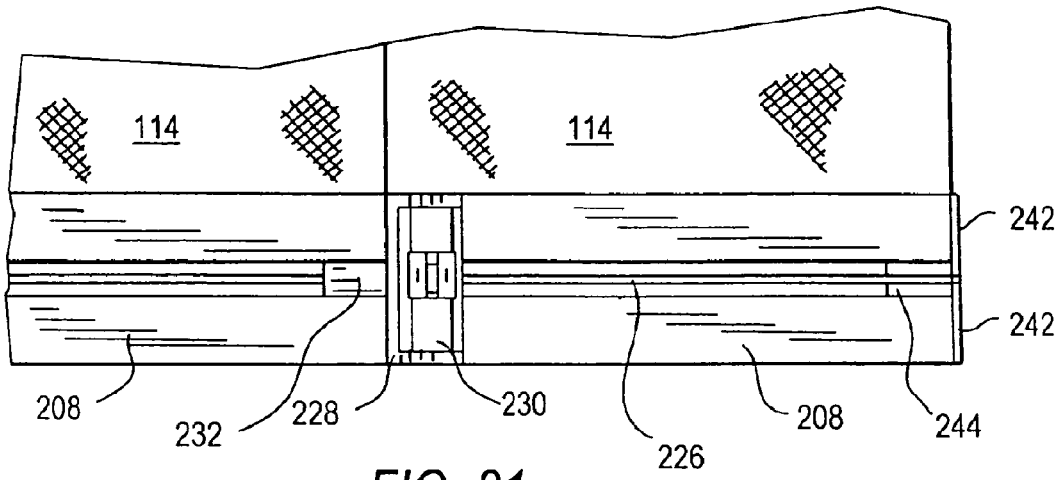
FIG. 31 is a plan view showing the connection of one bottom rail to the next.
Figure 32:
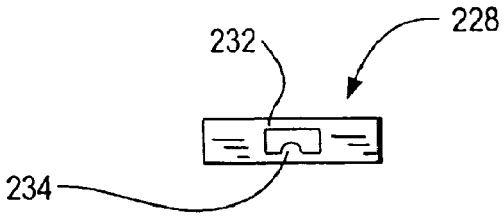
FIG. 32 is a plan view of the end of a coupling member.

FIG. 31 is a plan view, taken from behind two adjacent panels 114, showing the connection of one bottom rail 208 to the next. At the end of bottom rail 208 on the left-hand side of FIG. 31 is a coupling member 228 having a generally rectangular opening 230. Coupling member 228 is disposed at the hidden end of each bottom rail 208 in movable panels 114, that is, all panels 114 except that at the extreme left in FIGS. 14, 19 and 21. FIG. 32 is a plan view of the end of the coupling member 228 inserted into bottom rail 208 in FIG. 31. Insert member 232 fits snugly in channel 222 and behind flanges 224 in bottom rail 208, and has a cut-out 234 to accommodate rail 226.

Figure 33:
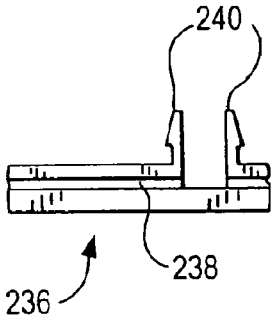
FIG. 33 is a side view of a linking member.
Figure 34:
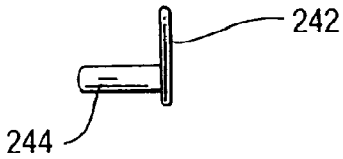
FIG. 34 is a plan view of an end cap.

Linking member 236 is shown in a side view in FIG. 33. Linking member 236 is slidable along channel 222 in bottom rail 208 guided by flanges 224, which fit within a groove 238 on each side of linking member 236, and against rail 226. Resilient locking members 240 snappingly fit within rectangular opening 230 to join one panel 114 to that behind it.

The visible ends of bottom rails 208 in FIGS. 14, 19 and 21 have end caps 242, as shown in FIG. 31. A plan view of an end cap 242 is provided in FIG. 34. Insert member 244 of end cap 242 fits snugly within channel 222 in the space between one of the two flanges 224 and the rail 226. Two end caps 242, oriented in opposite directions, are required to cover the end of the bottom rail 208.

Figure 35:
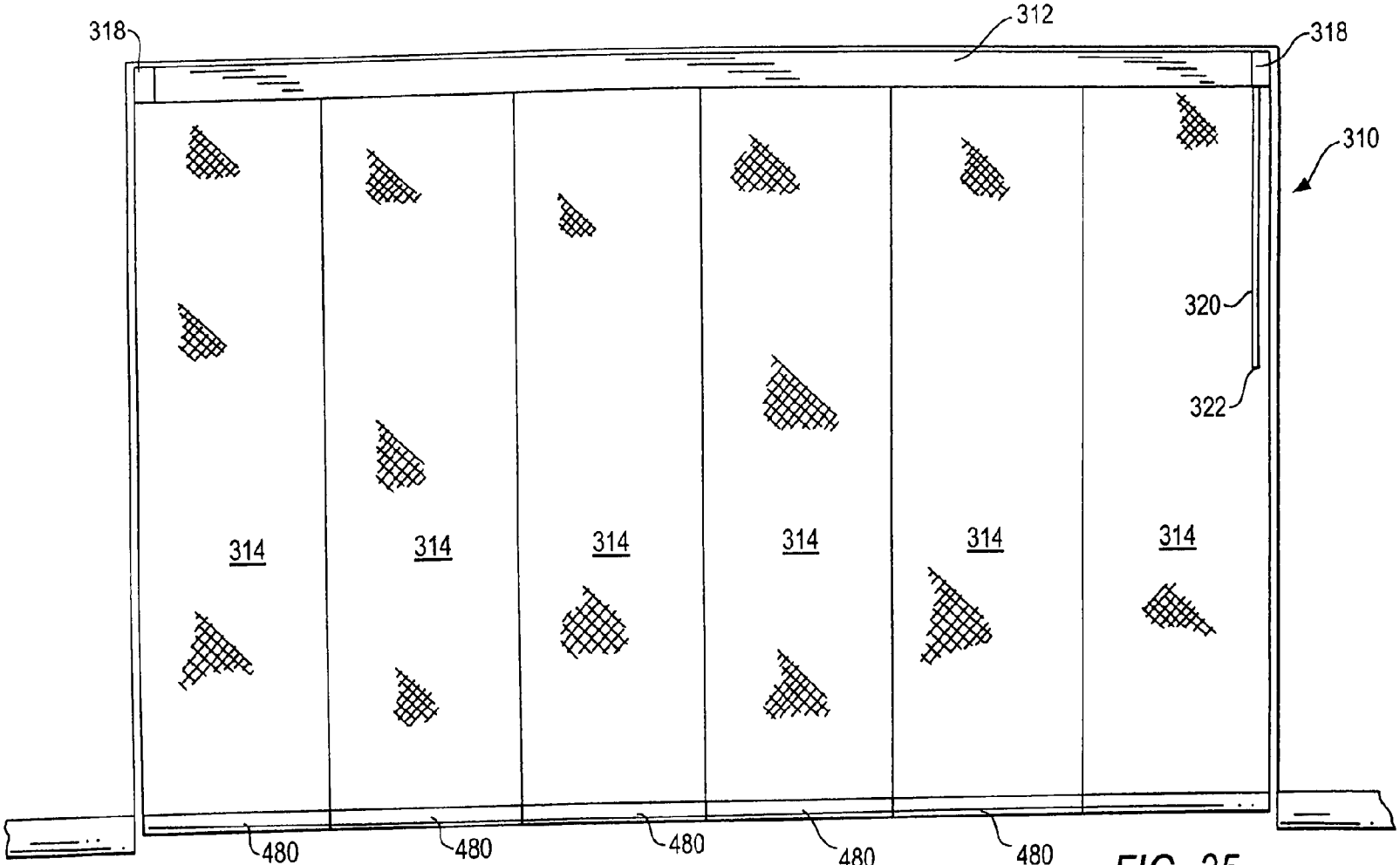
FIG. 35 is an elevational view of a fifth embodiment of the present invention.

A fifth embodiment of the present invention is shown in FIGS. 35 through 52. FIG. 35 is an elevational view of a covering 310 for an architectural opening. As shown in FIG. 35, the covering 310 includes a headrail 312, by which it may be mounted or suspended across the top of an architectural opening. The architectural opening shown in FIG. 35 is a window or sliding door of essentially floor-to-ceiling height. However, as previously indicated, this should not be understood by the reader to limit the present invention to coverings 310 used in architectural openings of that type, for it is equally applicable to windows and doors of al heights and widths.

Moreover, the description of covering 310 to follow includes several new features which are readily applicable to covering 110 shown in FIGS. 14 through 34. In short, it should not be assumed by the reader that the features in question may be incorporated only into coverings 310, as they are equally applicable to coverings 110 described above. By the same token, some of the previously described features may be used in coverings 310, as the reader will recognize in short order.

Figure 36:
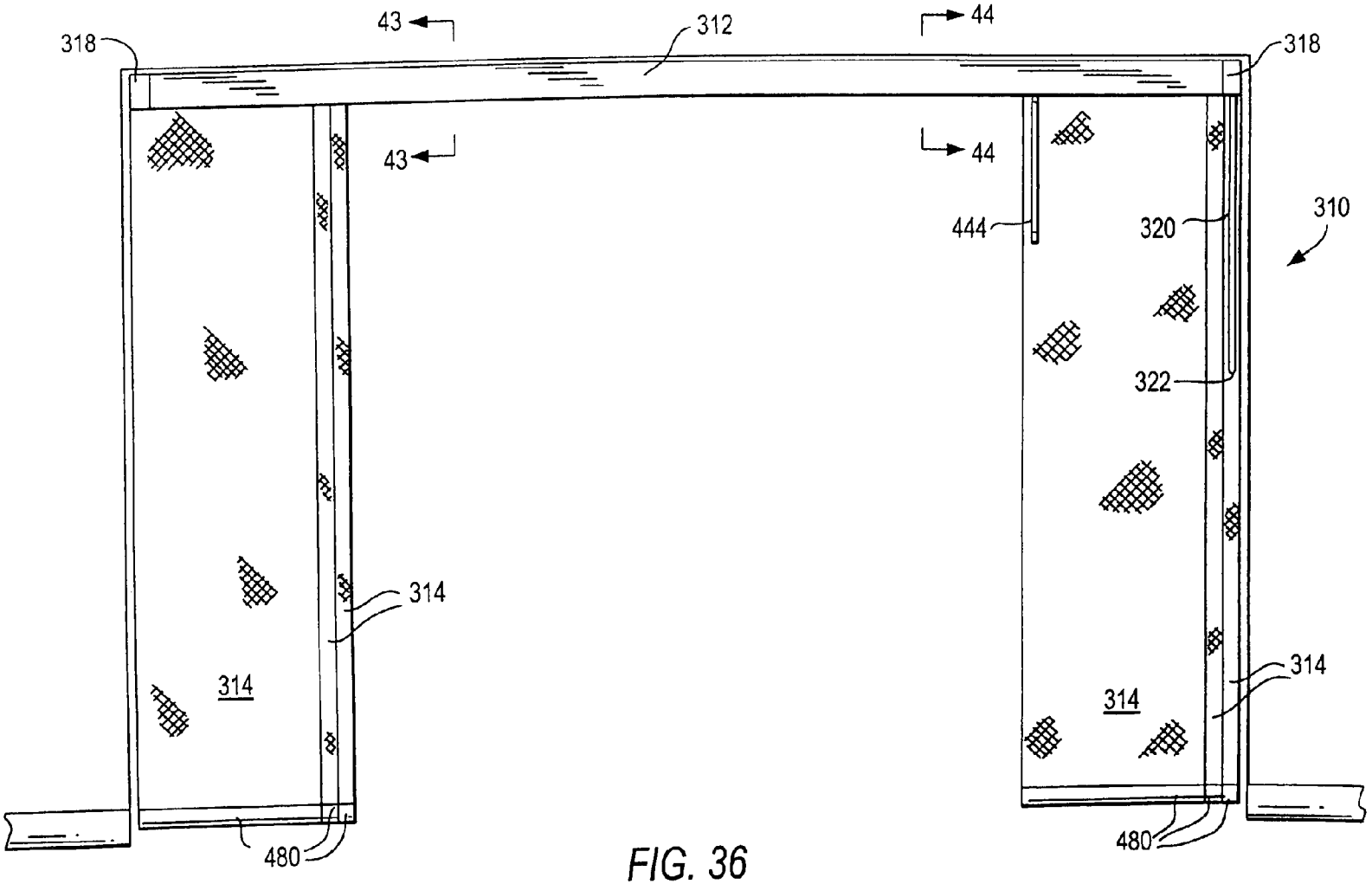
FIG. 36 is an elevational view of the fifth embodiment when fully opened.

Turning back now to FIG. 35, covering 310 comprises a plurality of individual panels 314 suspended from the headrail 312. Six such panels 314 are shown, although there is no intention on the part of the inventor to limit the present invention in this regard. When the covering 310 is opened, the panels 314 form two stacked arrays, one on the left-hand side and the other on the right-hand side of the architectural opening, as shown in FIG. 36. As such, covering 310 is of the "center draw" type, meaning that the covering 310 opens from the center, rather than from the left- or right-hand side. As above, however, the panels 314 are oriented at a fixed oblique angle relative to the longitudinal direction of the headrail 312.

At each end of the headrail 312 is an end cap 318 which covers, in the views presented in FIGS. 35 and 36, a cord-guiding member 316, whose structure and function will be described in complete detail below. Cord-guiding member 316 and end cap 318 differ from cord-guiding member 116 and end cap 118 of covering 110 in that end cap 318 truly covers cord-guiding member 316 from the view of one viewing the covering 310 once it has been installed above an architectural opening. As a consequence, one only needs to match the color of the end cap 318 to that of the headrail 312 to provide a pleasing appearance to those components, the color of the cord-guiding member being of less importance as it remains hidden from view.

Extending below end cap 318 at the right-hand end of the headrail 312 in FIGS. 35 and 36 is a cord 320 forming a loop 322. As with the fourth embodiment described above, cord 320 is used to open and close the covering 310, wherein pulling one side of the loop 322 will open the covering while pulling the other side of the loop will close it.

Figure 37:
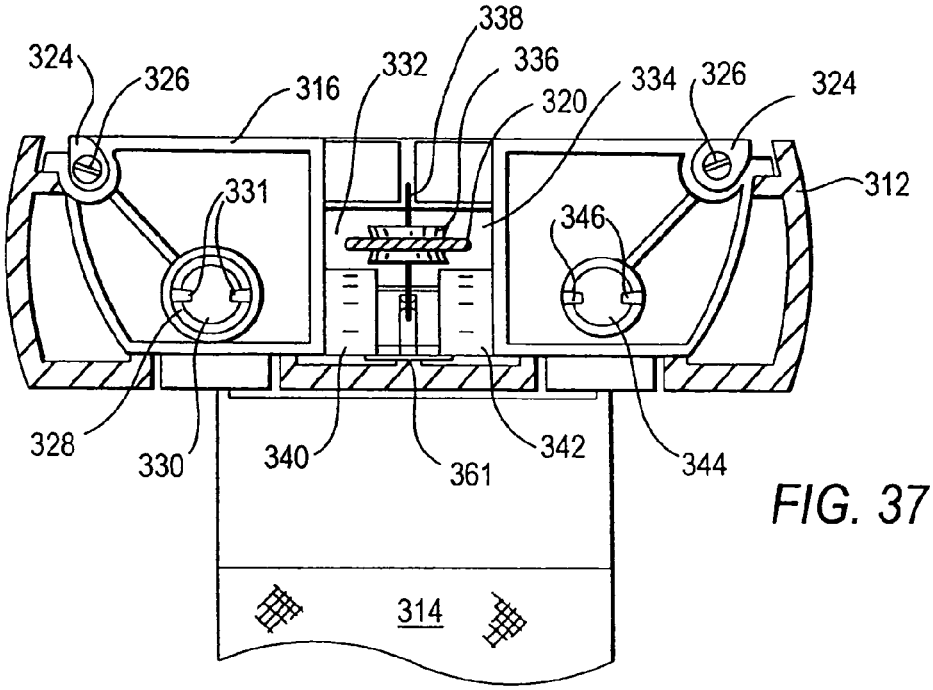
FIG. 37 is an elevational view of the fifth embodiment taken from the left-hand end of the headrail with the end cap removed.

FIG. 37 is an elevational view of the covering 310 taken from the left-hand end of headrail 312 in FIGS. 35 and 36 with the end cap 318 removed. A portion of the leftmost panel 314 in FIGS. 35 and 36 is shown hanging below headrail 312, and is oriented, as noted above, at an oblique angle with respect to the longitudinal direction of the headrail 312, such that the side of panel 314 seen in FIGS. 35 and 36 is visible, although viewed at a steep angle.

Cord-guiding member 316 has two holes 324 for screws 326 or the like used to attach cord-guiding member 316 to headrail 312, as will be shown further below. In contrast to the previous embodiment described above, cord-guiding member 316 does not completely cover headrail 312 because cord-guiding member 316 is subsequently to be completely covered by end cap 318. Cord-guiding member 316 has a further hole 328, in which is disposed a steel slug 330. Steel slug 330 may be held within hole 328 by an interference fit, by clips 331 or the like, and protrudes through the far side of hole 328. Steel slug 330 is used to immobilize the leftmost panel 314 in FIGS. 35 and 36. In the present embodiment, cord-guiding member 316 at the right-hand end of the headrail 312 also includes a steel slug 330 to immobilize the rightmost panel 314 in the same manner. In each case, the leftmost and rightmost carrier for the leftmost and rightmost panel 314, respectively, has a magnet, as will be illustrated below, which engages with steel slug 330 to immobilize the respective panel 314. This approach represents an improvement over fixing the leftmost or rightmost panel 314 with a screw or the like, as it provides a way to move those panels 314 temporarily away from the sides of the architectural opening for cleaning. Where the covering is of the variety which opens and closes from the extreme right or left, such a magnet would only be used at its fixed end.

Cord 320 in FIG. 37 passes outwardly from within headrail 312 through opening 332 and re-enters through opening 334. Between openings 332, 334 is a pulley 336 which rotates on axle 338. Pulley 336 enables cord 320 to pass readily out of opening 332 and into opening 334, or vice versa, when the loop 322 of cord 320 at the right-hand side of FIGS. 35 and 36 is manipulated to open or close the covering 310.

Cord-guiding member 316 also has curved channels 340, 342 disposed below openings 332, 334, respectively. Cord 320, which loops around pulley 336, may be grasped at pulley 336 and pulled out through openings 332, 334 to "move" the loop 322 from the right-hand side of covering 310, as shown in FIGS. 35 and 36, to the left-hand side, although, because covering 310 is of the "center draw" type, cord 320 must be temporarily disengaged from one of the two centermost panels 314 in a manner to be shown below while the loop 322 is being so "moved".

Cord-guiding member 316 also includes a further hole 344 with clips 346 to allow for the installation of a steel slug in a covering constructed as a mirror image of covering 310.

Figure 38:
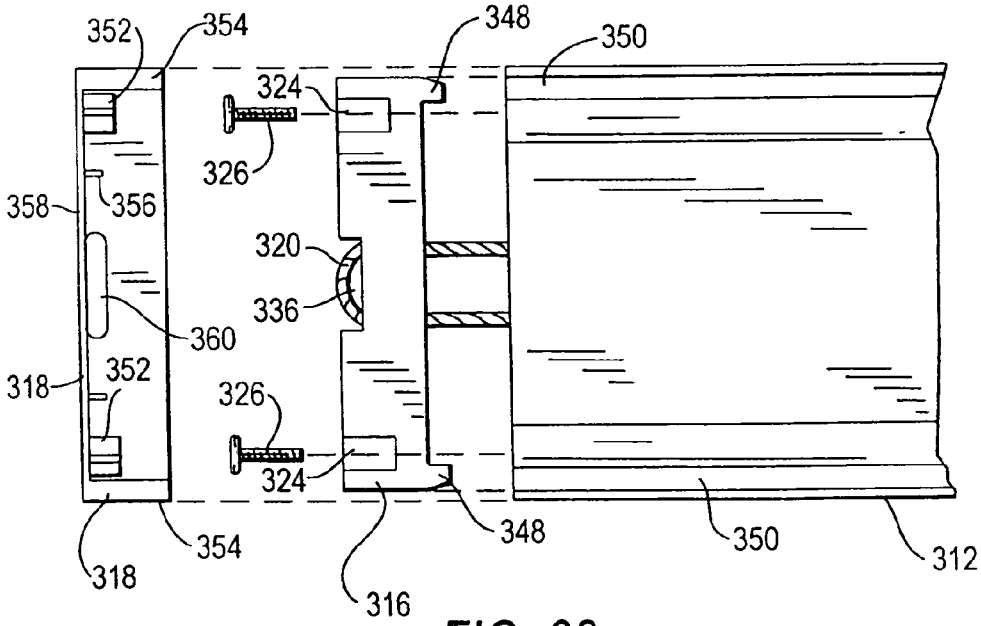
FIG. 38 is an exploded view of the left-hand end of the headrail of the fifth embodiment taken from above.

FIG. 38 is an exploded view of the left-hand end of the headrail 312 taken from above. Cord 320 runs within headrail 312, around pulley 336 of cord-guiding member 316 and back into headrail 312 toward the right-hand end thereof. Screws 326 are directed through holes 324 to attach cord-guiding member 316 to the end of the headrail 312. Cord-guiding member 316 further has posts 348 which fit into channels 350 on headrail 312 to properly align and stabilize cord-guiding member 316 onto headrail 312.

End cap 318 has posts 352 which may be held within hole 324 in cord-guiding member 316 by interference fit when end cap 318 is secured onto cord-guiding member 316. It will be observed that end cap 318 has side walls 354 which fit over and surround cord-guiding member 316 when end cap 318 is secured thereover. End cap 318 further has a pin 356 on the inner face of end wall 358. When end cap is secured over cord-guiding member 316, pin 356 bears against steel slug 330 to prevent it from being readily dislodged from hole 328 during the life of the covering 310. It should be understood that steel slug 330 may alternatively be of any other ferromagnetic material, and may itself be a magnet. Finally, end cap 318 includes a hole 360 through which a loop 322 of cord 320 may be directed when the end cap 318 is placed over the cord-guiding member 316. Moreover, referring for a moment back to FIG. 37, the underside of cord-guiding member 316 has a rib 361. When end cap 318 is installed over cord-guiding member 316 and pushed thereover to completely cover it, rib 362 snappingly extends into hole 360 to prevent end cap 318 from being easily removed.

Figure 39:
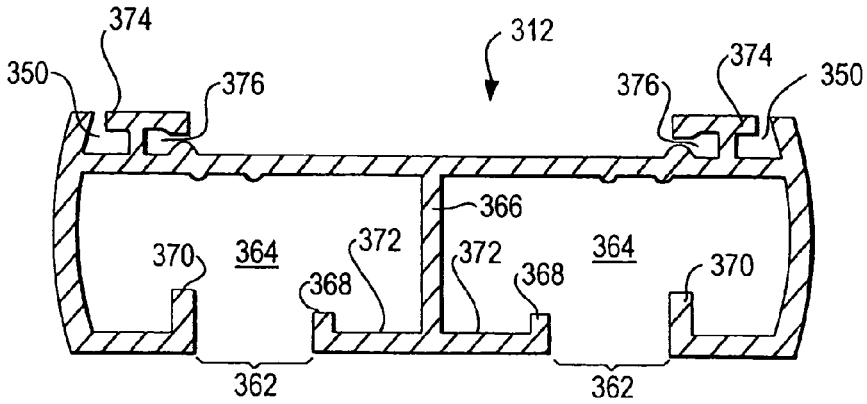
FIG. 39 is a cross-sectional view of the headrail of the fifth embodiment.

FIG. 39 is a cross-sectional view of headrail 312. Headrail 312, again constituting a single track, includes two rails 362. Associated with each rail 362 is an interior compartment 364, each compartment 364 being separated from the other by interior wall 366. Rails 362 are more particularly defined by flanges 368, 370 which extend into interior compartments 364. Flanges 370, which are outside of rails 362 relative to interior wall 366, are longer than flanges 368 for improved stabilization of the carriers, to be described below, from which the panels 314 are suspended, and to facilitate assembly by insuring that those carriers may only fit onto rails 362 in a correct direction. Between interior wall 366 and flange 368 is a ledge 372. As previously described above, ledges 372 align with openings 332, 334 in cord-guiding members 316. As a consequence, ledges 372 again support cord 320 within headrail 312.

On the upper exterior of headrail 312 are flanges 374 by which it may be attached to appropriate hardware installed above an architectural opening for mounting purposes. In addition, there are channels 376 which align with holes 324 in cord-guiding members 316 enabling screws 326 or the like to be driven into channels 376 to attach cord-guiding members 316 to the ends of the headrail 312. Channels 350, as noted above, accommodate posts 348 on cord-guiding members 316 for proper alignment thereon.

It will be noted that headrail 312 is substantially the same as headrail 112 previously described for the fourth embodiment above, the differences being the difference in the lengths of flanges 368, 370, where in headrail 112, the flanges 154 are of equal length, and the location of flanges 374, which are farther apart from one another than flanges 150 of headrail 112.

Figure 40A:
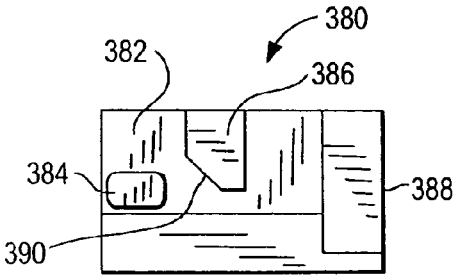
FIG. 40A is a side view of a carrier for the panels of the fifth embodiment.

FIGS. 40A through 40F are views of carrier 380 designed for use in headrail 312. FIG. 40A is a side view of carrier 380 showing the side of carrier 380 which rests upon and slides along flange 370 in headrail 312. Instead of screw 166 on carrier 162, face 382 of carrier 380 has an integrally formed button 384. Face 382 also has a wedge-shaped element 386 and a tab 388. Tab 388 has the same function as tab 168 on carrier 162, namely, a strap attached to an adjacent carrier 380 fits between face 382 and tab 388 so that the distance between adjacent panels 314 may be fixed when the covering 310 is closed. Button 384 is used to connect a strap to carrier 380, and wedge-shaped element 386 deflects a strap passing between tap 388 and face 382 outward from button 384. Button 384 is essentially rectangular in shape from the vantage point of FIG. 40A for reasons to be given below. Finally, wedge-shaped element 386 has an oblique edge 390 having a purpose to be given below.

Figure 40B:
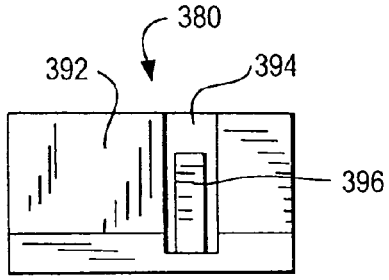
FIG. 40B is a view of the opposite side of the carrier from that shown in FIG. 40A.

FIG. 40B is a view of the opposite side of carrier 380 from that shown in FIG. 40A. The side shown in FIG. 40B rests upon and slides along flange 368 in headrail 312 and, as a consequence, faces interior wall 366. Face 392 shown in FIG. 40B has a gap 394 through which a post 396 within carrier 380 is visible. Post 396 will be described below.

Figure 40C:
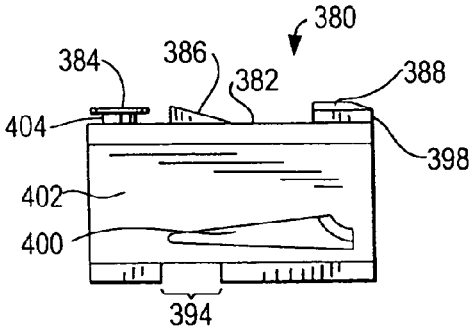
FIG. 40C is a view of the carrier taken from below that shown in FIG. 40A.

FIG. 40C is a view of carrier 380 taken from below that shown in FIG. 40A. As above, tab 388 is separated from face 382 by gap 398. Further, the inclination of wedge-shaped element 386 is readily apparent in the view of FIG. 40C. Finally, there is an opening 400 through the bottom 402. Opening 400 is used to mount the hangers which hold the panels 314. Finally, referring to button 384, it may be seen in FIG. 40C to have a post 404 reduced in size thereto.

Figure 40D:
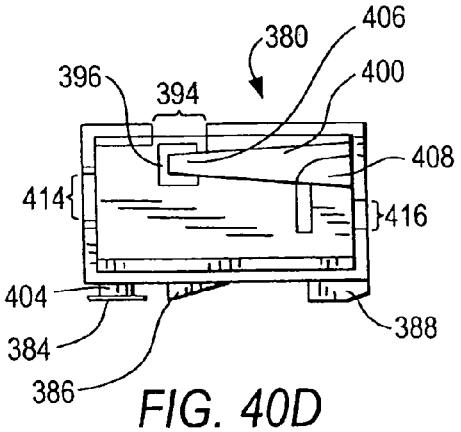
FIG. 40D is a view of the carrier taken from above that shown in FIG. 40A.

FIG. 40D is a view of carrier 380 taken from above that shown in FIG. 40A. Post 396, now seen from above, has a U-shaped portion 406 which forms a part of opening 400. In addition, the inside of the carrier 380 has a ledge 408. One end of the hanger, from which panel 314 is suspended, is held by carrier 380 resting on ledge 408 and held thereon by U-shaped portion 406 of post 396.

Figure 40E:
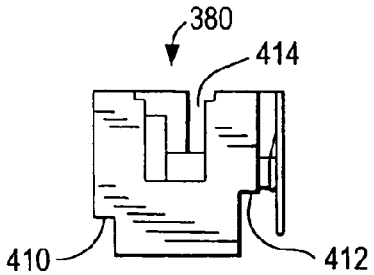
FIG. 40E is a view of the carrier taken from the left of that shown in FIG. 40A.
Figure 40F:
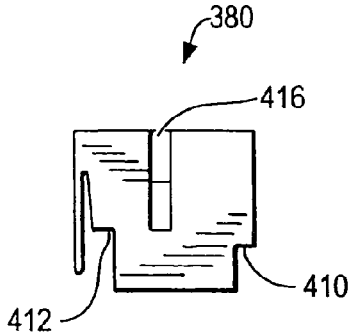
FIG. 40F is a view of the carrier taken from the right of that shown in FIG. 40A.

FIG. 40E is a view of carrier 380 taken from the left of that shown in FIG. 40A, and FIG. 40F is a view thereof taken from the right of that shown in FIG. 40A. Both FIGS. 40E and 40F show shoulders of unequal height on the sides of the carrier 380. Shoulder 410 rests upon and slides on flange 368 in headrail 312, while shoulder 412 does so on flange 370. As noted previously, the shoulders 410, 412 of unequal height, together with the flanges 368, 370 of unequal height, ensure that the carriers 380 can only be inserted on the rails 362 of headrail 312 in one direction. Both the right and left ends of the carrier 380 have gaps 414, 416, respectively, which are also visible in FIG. 40D and which are provided to attach other elements to the carrier 380, as will be discussed below.

Figure 41:
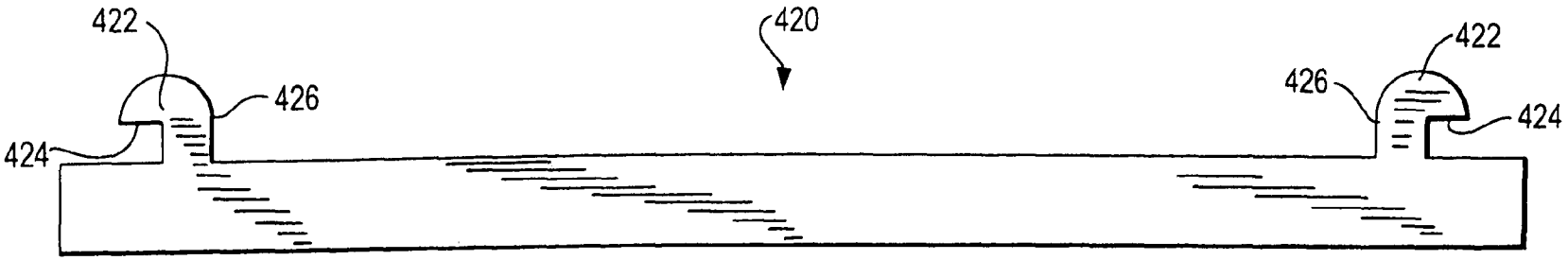
FIG. 41 is a plan view of a hanger for the panels in the fifth embodiment.

FIG. 41 is a plan view of a hanger 420, which, like hanger 190 shown in FIG. 25, may be of relatively inflexible metal or plastic sheet material. Hanger 420 may be of any desired length, depending primarily on the width of the covering 310 and on the number of panels 314 included therein. There is, as before, one hanger 420 per panel 314, and two carriers 380, one in each rail 362 of headrail 312, for each panel 314, the carriers 280 for each panel 314 being oriented in opposite directions. Panels 314 may be attached to hangers 420, preferably on the side of hangers 420 away from the viewer within a room where the covering 310 is installed. In contrast to hanger 190 of FIG. 25, hanger 420, except for two oppositely facing hook-like members 422, is essentially an elongated rectangle lacking the oblique ends of hanger 190 to provide greater surface area for the adhesive fastening of panels 314 thereto.

As noted in passing above, hanger 420 has two oppositely facing hook-like members 192. To attach hanger 420 and panel 314 to carriers 380, the hook-like members 422 are inserted from below carriers 380 upward through opening 400 until the underside 424 of hook-like member 422 rests upon ledge 408, seen in FIG. 40D of the carrier 380 viewed from above. Upright portion 426 of hook-like member 422 fits into U-shaped portion 406 of post 396 to hold the hook-like member 422 in position. Clearly, referring to FIG. 40D again, it is possible for hanger 420 to fall out of carrier 380 if hanger 420 is bent or distorted in a way that causes underside 424 of hook-like member 422 to move off of ledge 408. This is addressed in this fifth embodiment of the covering 310 in a manner to be described below.

Figure 42:
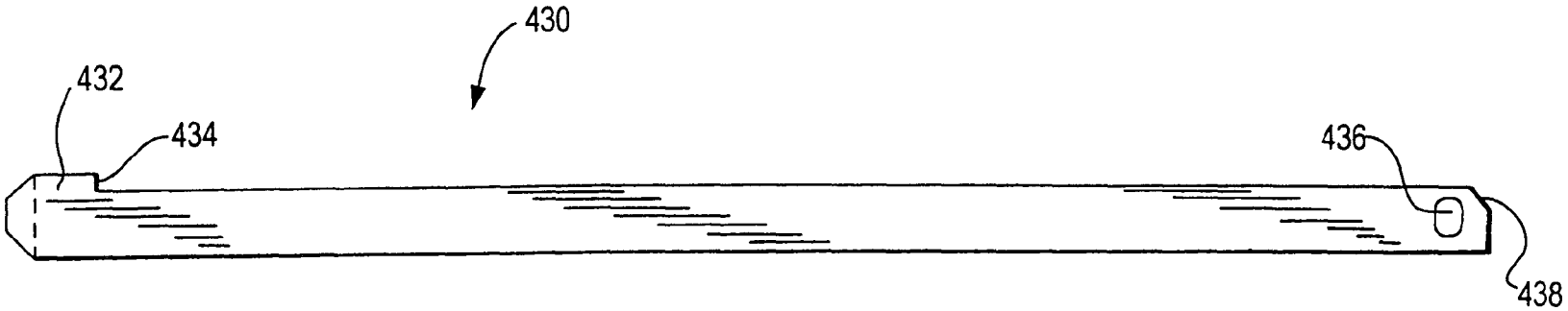
FIG. 42 is a plan view of a strap for linking the panels of the fifth embodiment together.

FIG. 42 is a plan view of a strap 430 for linking panels 314 of covering 310 together. Strap 430 functions essentially in the same manner as strap 196 previously described. Strap 430 is a flexible strip of metal or plastic sheet, and is of uniform width except for an abruptly widened portion 432 beginning with a step 434. A terminal portion 436 may be bent upward slightly from the plane formed by the strap 430. The step 434 and terminal portion 436 function as described previously above.

At the opposite end of the strap 430 is an essentially rectangularly shaped hole 436 and an oblique edge 438. Hole 436 is of minimally larger dimension than button 384 on carrier 380, and is used to attach strap 430 to carrier 380. When button 384 is inserted through hole 436 and strap 430 is then rotated relative to carrier 380 about post 404, button 384 prevents strap 430 from slipping from the carrier 380. Moreover, oblique edge 438 at that point snaps into position against oblique edge 390 on wedge-shaped element 386 to prevent further rotation of strap 430 relative to holder 380 to ensure that strap 430 will not readily slip from carrier 380.

It will be noted the strap 430 lacks a series of holes, but rather has one single hole 436. As a consequence, straps 430 of desired length are used when constructing carriers 310 of different panel width and overlap amount.

Figure 43:
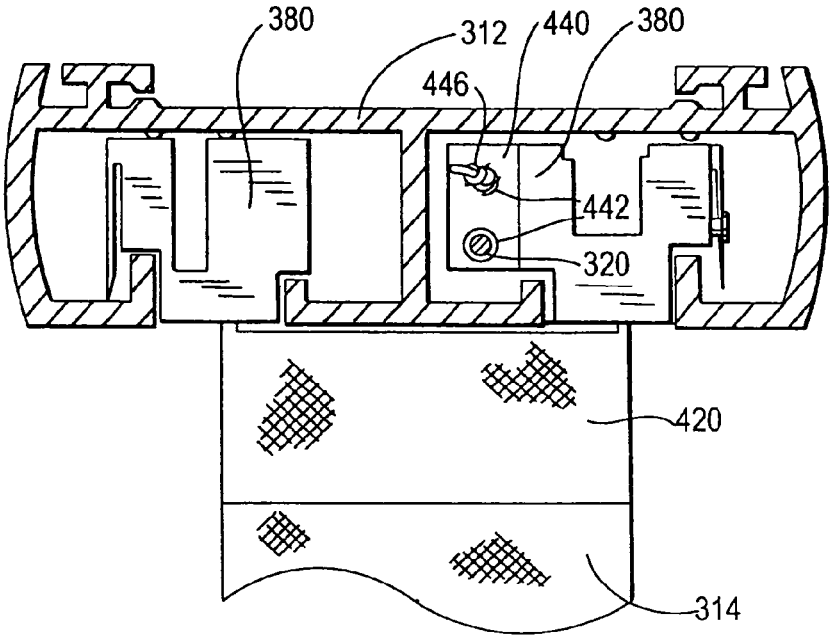
FIG. 43 is a cross-sectional view taken as indicated in FIG. 36.

FIG. 43 is a cross-sectional view taken through headrail 312 as indicated in FIG. 36. The rear side of the rightmost panel 314 on the left-hand side of FIG. 36 is visible below the headrail 312. The material of panel 314, as noted above, is secured by an adhesive to that side of the hanger 420. The side of carrier 380 shown in FIG. 40F is visible on the left side of the headrail 312; that shown in FIG. 40E is visible on the right side of the headrail 312. Though not readily apparent from the view presented in FIG. 43, carrier 380 on the left-hand side of the headrail 312 is closer to the viewer than that on the right-hand side.

A cord securing member 440 is attached to the carrier 380 on the right-hand side of the headrail 312 using gap 394 shown on the side of the carrier 380 illustrated in FIG. 40B. Cord-securing member 440 has two holes 442. As discussed above in connection with FIG. 23, the two ends of cord 320 running from the left end right ends of the headrail 312, respectively, terminate and are tied off at holes 442 in cord-securing member 440. When the cord 320 is appropriately manipulated at loop 322, cord-securing member 440 will move carrier 380 to which it is attached one way or another along the headrail 312 to open and close the covering 310.

In this fifth embodiment of the covering 310, it is possible to eliminate the loop 322 of cord 320 at one of the two ends of the headrail 312, and, instead, to open and close the covering 310 using a wand. Such a wand 444 is shown in FIG. 36 by way of example. The wand 444 could, alternatively, be installed on the left-hand side of the covering 310, or on both the left-end right-hand sides. The loop 322 itself is eliminated by pulling cord 320 using knot 446 at the top hole 442 in cord-securing member 440 to pull out the excess cord 320 forming loop 322, cutting the excess cord 320 and tying it off. In order to perform this operation, it may too be necessary to temporarily disengage the cord 320 from the left-hand side of the covering 310.

Figure 44:
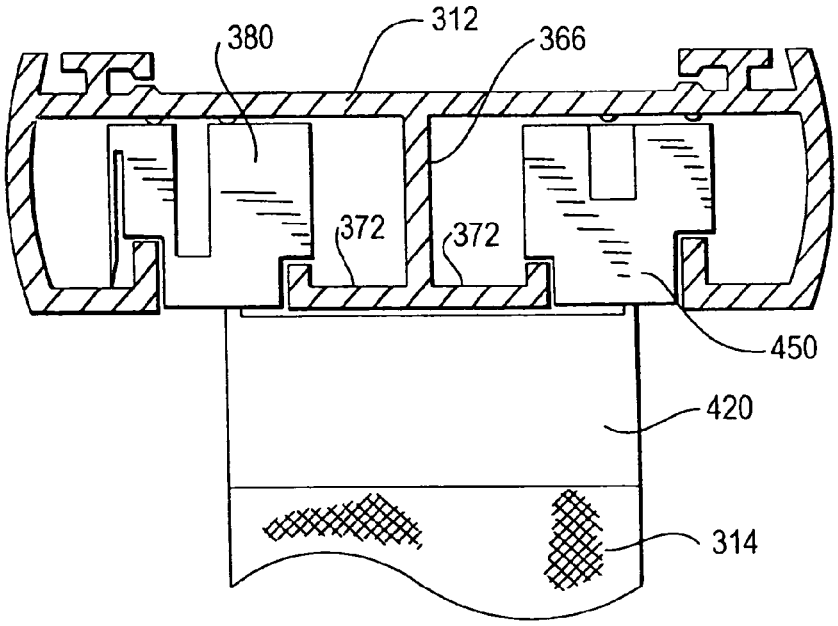
FIG. 44 is another cross-sectional view taken as indicated in FIG. 36.

FIG. 44 is a cross-sectional view taken through headrail 312 as indicated in FIG. 36, although, for the sake of clarity, wand 444 is not shown. As in FIG. 43, the side of carrier 380 shown in FIG. 40F is visible on the left side of the headrail 312. The front side of the leftmost panel 314 on the right-hand side of FIG. 36 is visible below the headrail 312. The material of the panel 314 is secured to the rear side of the hanger 420 as indicated. Though not readily apparent from the view presented in FIG. 44, carrier 380 on the left-hand side of the headrail 312 is closer to the viewer than the element on the right-hand side of the headrail 312.

That element is cord-securing member 450, which is attached to the side of carrier 380 shown in FIG. 40E and which obscures carrier 380 from view in the right-hand side of FIG. 44. Cord-securing member 450, whether the covering 310 is opened and closed by a loop 322 of cord 320 or a wand 444, enables the left- and right-hand sides of the covering 310 to move in opposite directions when the covering is being opened and closed.

Figure 45:
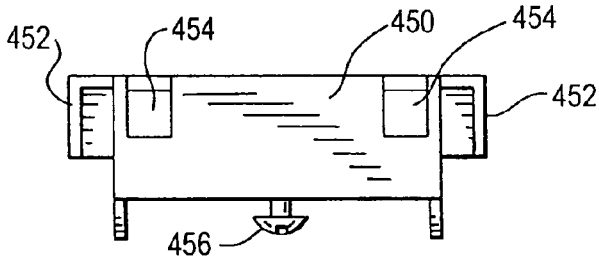
FIG. 45 is a side view of a cord-securing member used in the fifth embodiment.

An end view of cord-securing member 450 is included in FIG. 44. A side view thereof, specifically a view of the side facing interior wall 366 of headrail 312 is shown in FIG. 45. Though not shown in FIG. 44 for the sake of clarity, cord 320 runs between the two ends of the headrail 312 on ledges 372.

Referring to FIG. 45, cord-securing member 450 has a generally rectangular box-like structure. At each end is a coupler 452 for use in connecting the cord-securing member 450 to other components, such as carrier 380. Most importantly, the side of cord-securing member 450 shown in FIG. 45 has two openings 454, so that cord 320 may be directed in one and out the other. Within the cord-securing member 450 is a screw 456 or similar fastener about which the cord 320 is wrapped therewithin, and the screw 456 tightened thereon to secure the cord 320. The cord-securing member 450 is the means by which the cord 320 is engaged to the left-hand side of the covering 350, and has previously been alluded to in connection with the "movement" of the loop 322 of cord 320 from one end of the headrail 312 to the other and in connection with the optional elimination of the loop 322.

Figure 46:
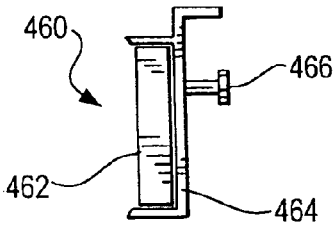
FIG. 46 is a top plan view of a magnet holder for a carrier.

It will be recalled now from the earlier discussion of cord-guiding member 316 at each end of headrail 312 that the leftmost and rightmost carriers 380 for the leftmost and rightmost panels 314, respectively, each have a magnet which engages with steel slug 330 in cord-guiding member 316 to immobilize those panels 314. FIG. 46 is a top plan view of a magnet holder 460 with magnet 462. Holder 464 is designed for attachment to the side of carrier 380 shown in FIG. 40F at gap 416 using T-shaped member 466.

Figure 47:
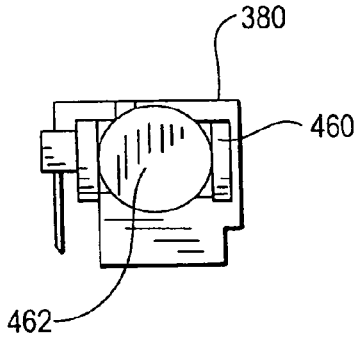
FIG. 47 is a plan view of a carrier with the magnet holder attached.

FIG. 47 is a plan view of the side of carrier 380 shown in FIG. 40F with the magnet holder 460 attached. Magnet 462 is thereby held in a position where it will contact steel slug 330 in cord-guiding member 316 at the ends of headrail 312 to hold the leftmost and rightmost panels 314 in place, but to permit their temporary removal therefrom for housekeeping purposes. Again, where the covering is of the variety which opens and closes from the extreme right or left, such a magnet holder 460 would only be used at its fixed end.

Referring now to FIG. 40D, it will be recalled that it is possible for hanger 420 to fall out of carrier 380 if hanger 420 is bent or distorted in a way that causes underside 424 of hook-like member 422 to move off of ledge 408 because hanger 420 must be slightly and temporarily bent to be properly installed in carrier 380 in the first place. Similar bending or distortion could occur when covering 310 is being opened or closed, or, more specifically, when it just reaches the fully opened or closed position and further pulling on the loop 322 of cord 320 or wand 444 places a strain on the carrier 380 being driven by either of these mechanisms. To prevent such a strain from being placed on a carrier 380, spacers may be installed at appropriate points in the rails 362 of the headrail 312.

Figure 48:
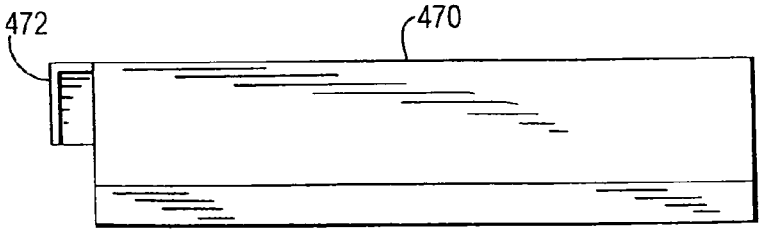
FIG. 48 is a side view of a spacer.

Such a spacer 470 is shown in a side view in FIG. 48. Spacer 470 has coupler 472 by which it is attached to the end of carrier 380 shown in FIG. 40E, and slides along flanges 368, 370 in the same mariner as carrier 380. Spacer 470 is essentially of the same length as the distance occupied by a panel 314 in the longitudinal direction of the headrail 312.

In a "center-draw" covering 310 of the variety shown in FIGS. 35 and 36, a spacer 470 may be attached to the carriers 380 for the rightmost panel 314 on the left-hand side of FIG. 36 or to the carriers 380 for the leftmost panel 314 on the right-hand side of FIG. 36, so long as there is only one such spacer 470 in each rail 362 of the headrail 312. It will be appreciated that the spacer 470 may also be used to attach wand 444. The spacers 470 in this situation act as "stops" and prevent the loop 322 of cord 320 or wand 444 to be pulled sufficiently hard to cause panels 314 to fall from carriers 380.

In a covering where the panels stack at the extreme right or left of the architectural opening, a spacer 470 would be required between the end of the headrail and the carrier on the panel actually moved by the cord to prevent the cord from pulling sufficiently hard to cause the panels 314 to fall from the carrier. As above, carriers 470 could also be used to mount wands on either side of such a covering, and may be so provided on both sides thereof. For this use, shorter carriers 470 than those described above could be used.

Turning now to improved characteristics of the bottom of the covering 310, which characteristics are also intended for use in covering 110 described above, each panel 314 of covering 310 shown in FIGS. 35 and 36 has a bottom rail 480 which provides the necessary weight to keep the panels 314 taut and hanging vertically and less susceptible to swaying with the slightest air movement. Moreover, as before, bottom rails 480 enable the panels 314 to be connected to one another, as will be shown more particularly below, to dampen out any swaying motion and to provide a more pleasing appearance.

Figure 49:
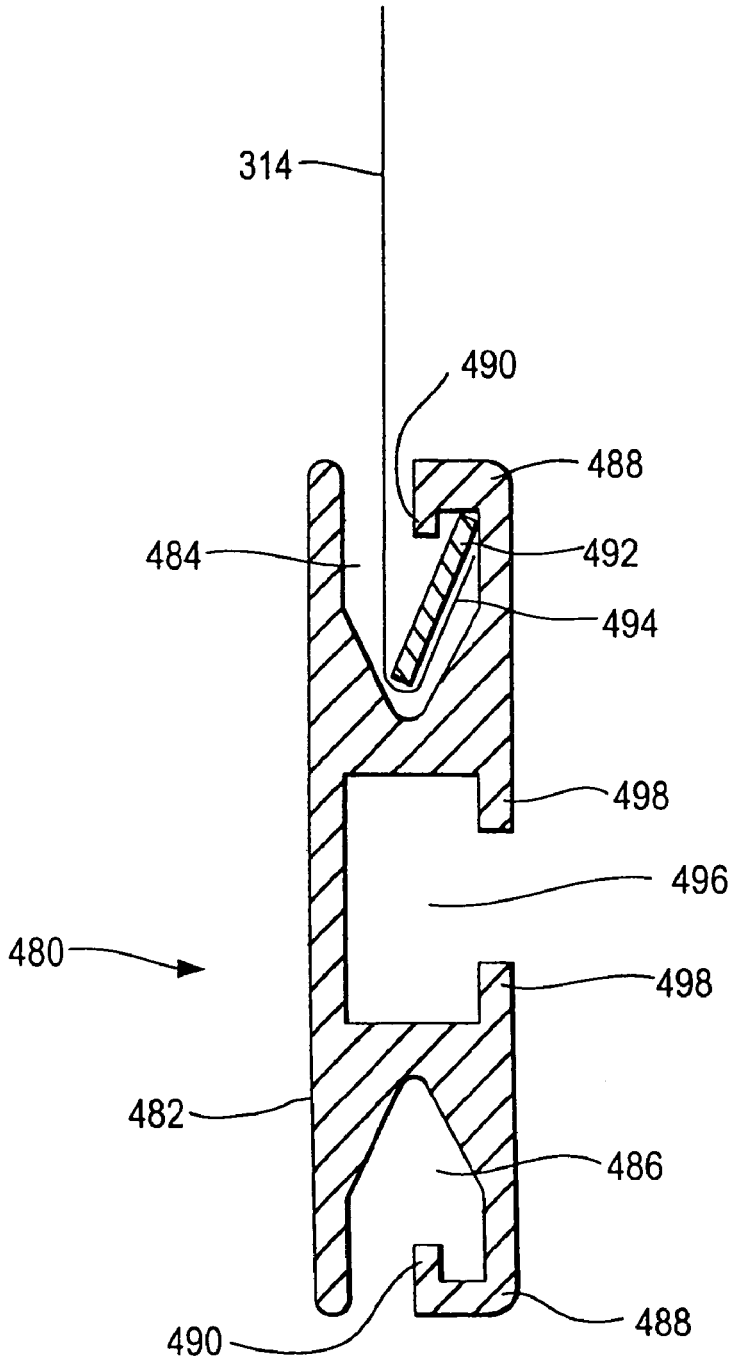
FIG. 49 is a cross-sectional view of a bottom rail and panel for the fifth embodiment.

FIG. 49 is a cross-sectional view of the bottom rail 480 attached to any one of the panels 314. Bottom rail 480 has smooth face 482, which faces the viewer of FIGS. 35 and 36. Bottom rail 480 also has an upper V-shaped channel 484 and a lower V-shaped channel 486. Each of the upper and lower V-shaped channels 484, 486 has a hook-like member 488 on one of its two sides, specifically the side not facing the viewer of FIGS. 35 and 36. The hook-like members 488 extend toward the front smooth face 482 of the bottom rail 480 and terminate with an element 490 directed into the upper and lower V-shaped channels 484, 486.

Panel 314 is secured in upper V-shaped channel 484 with a strip 492 of plastic material. Strip 492 is seen in cross section in FIG. 49. Panel 314 extends downwardly into upper V-shaped channel 484, under strip 492 and around to the backside 494 thereof, where it may be secured by an adhesive. Hook-like member 488 and especially element 490, which extends partially around strip 492 and prevents its removal upwardly out of V-shaped channel 484, keep the bottom rail 480 attached to the panel 314. In this regard, bottom rail 480 is an improvement over bottom rail 208 shown in FIG. 30.

The rear side of bottom rail 480 has a channel 496 of generally rectangular cross-sectional shape. The channel 496 has a flange 498 on each side of its opening. Channel 496, as before, is used in connecting each panel 314 to its neighbors.

Figure 50:
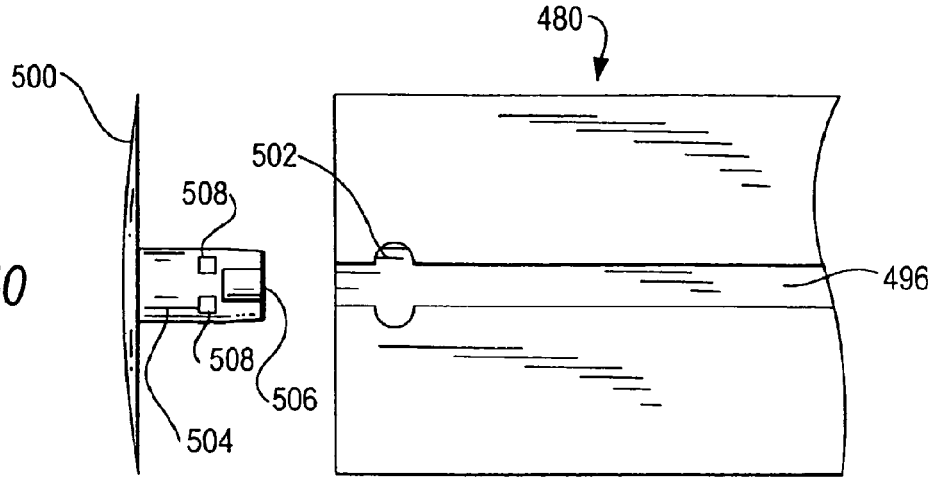
FIG. 50 is an exploded view of the backside of a bottom rail and an end cap.
Figure 51:
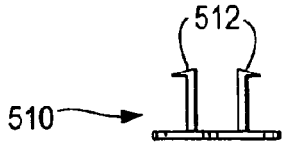
FIG. 51 is an elevational view of a locking element.
Figure 52:
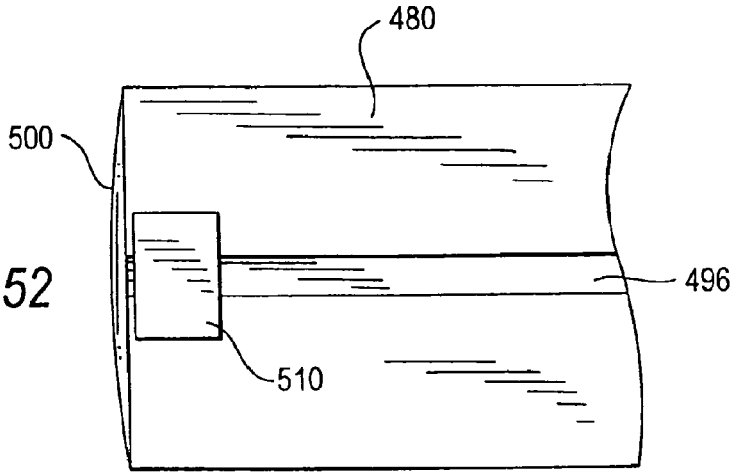
FIG. 52 is a view of the backside of the bottom rail with end cap attached.

FIG. 50 is an exploded view of the back side of a bottom rail 480 and an end cap 500 which may be connected thereto in an improved manner to that previously shown above. At the end of the bottom rail 480, oppositely facing portions of flanges 498 are machined to produce a widened opening 502 in comparison to that between flanges 498. End cap 500 has an insert member 504 which fits snugly within channel 496 behind flanges 498. Insert member 504 has a raised portion 506 which fits between flanges 498. Such a raised portion 506 is not present on the side of insert member 504 not shown in FIG. 50. Its function is to ensure that the insert member 504 can only be inserted into channel 496 with raised portion 506 disposed between the flanges 498.

When the insert member 504 is so inserted into the channel 496, holes 508 are disposed in widened opening 502. At that point, locking element 510, shown in FIG. 51 and having two oppositely directed prongs 512, is inserted and snapped into holes 508 to produce the view shown in FIG. 52. A coupling member, like coupling member 228 snapped into holes 508 to produce the view shown in FIG. 52. A coupling member, like coupling member 228 shown above but modified to have an insert member like insert member 508, may be installed on the ends of bottom rails 480 in the same manner where necessary. Linking member 236, as previously shown, may be used to link the bottom rails 480 together.

Modifications to the above would be obvious to those of ordinary skill in the art, but would not bring the invention so modified beyond the scope of the appended claims.

What is claimed is:

1. A single-track stacking panel covering for an architectural opening, the covering comprising:

a) a headrail for mounting the covering above and in front of the architectural opening, the headrail having a longitudinal direction, a first and a second end, and a single track running in the longitudinal direction including a first rail and a second rail disposed on opposite faces thereof;

b) a plurality of carriers disposed on the single track, the carriers being translatable in the longitudinal direction of the headrail to open and close the covering;

c) a plurality of panels suspended below the headrail, each panel being suspended from the plurality of carriers from at least two spaced-apart locations on each panel, each of the panels being oriented at a substantially fixed oblique angle relative to the longitudinal direction of the headrail, and having a width, a bottom and a top;

d) a pantograph having a first end and a second end and a plurality of links, the first end of the pantograph being in a fixed position in the first rail and the second end of the pantograph being extendable and collapsible along the first rail relative to the first end, a plurality of selected links of the pantograph being connected by substantially horizontal wires to a plurality of wheels disposed in the second rail, the wires forming at least in part the plurality of carriers, the plurality of panels being suspended from the plurality of carriers; and e) connectors for slidably linking each of the panels to those adjacent thereto, so that the panels may form an overlappingly stacked array at one of the first and second ends of the headrail by sliding one behind the next when the covering is opened.

2. The single-track stacking panel covering of claim 1, wherein the tops of the panels are each folded over the carriers and secured thereto.

3. The single-track stacking panel covering of claim 1, wherein each of the panels has a bar at the bottom thereof and extending for the width of the panel.

4. A single-track stacking panel covering for an architectural opening, the covering comprising:

a) a headrail for mounting the covering above and in front of the architectural opening, the headrail having a longitudinal direction, a first and a second end, and a single track running in the longitudinal direction including a first rail and a second rail disposed on opposite faces thereof;

b) a plurality of carriers disposed on the single track, the carriers being translatable in the longitudinal direction of the headrail to open and close the covering;

c) a plurality of panels suspended below the headrail, each panel being suspended from the plurality of carriers from at least one location on each panel, each of the panels being oriented at a substantially fixed oblique angle relative to the longitudinal direction of the headrail, and having a width, a bottom and a top;

d) a pantograph having a first end and a second end and a plurality of links, the first end of the pantograph being in a fixed position in the first rail and the second end of the pantograph being extendable and collapsible along the first rail relative to the first end, a plurality of selected links of the pantograph being connected by substantially horizontal wires to a plurality of wheels disposed in the second rail, the wires forming at least in part the plurality of carriers, the plurality of panels being suspended from the plurality of carriers; and e) connectors for slidably linking each of the panels to those adjacent thereto, so that the panels may form an overlappingly stacked array at one of the first and second ends of the headrail by sliding one behind the next when the covering is opened.

5. The single-track stacking panel covering of claim 4, wherein the tops of the panels are each folded over the carriers and secured thereto.

6. The single-track stacking panel covering of claim 4, wherein each of the panels has a bar at the bottom thereof and extending for the width of the panel.

7. The single-track stacking panel covering of claim 4, wherein the panels are each suspended from one central point on the respective carriers.

8. The single-track stacking panel covering of claim 4, wherein the panels are each suspended from two points on the respective carriers.

* * * * *